US012181178B2

(12) United States Patent
Lei et al.

(10) Patent No.: US 12,181,178 B2
(45) Date of Patent: Dec. 31, 2024

(54) MOUNTING BRACKET ASSEMBLY AND WINDOW AIR CONDITIONER ASSEMBLY

(71) Applicants: GD MIDEA AIR-CONDITIONING EQUIPMENT CO., LTD., Foshan (CN); MIDEA GROUP CO., LTD., Foshan (CN)

(72) Inventors: Zhisheng Lei, Foshan (CN); Zhigang Xing, Foshan (CN); Hui Yu, Foshan (CN); Wenjun Shen, Foshan (CN); Yuhang Tang, Foshan (CN); Kangwen Zhang, Foshan (CN); Ali Zhao, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 130 days.

(21) Appl. No.: 17/775,832

(22) PCT Filed: Mar. 13, 2020

(86) PCT No.: PCT/CN2020/079313

§ 371 (c)(1),
(2) Date: May 10, 2022

(87) PCT Pub. No.: WO2021/120424

PCT Pub. Date: Jun. 24, 2021

(65) Prior Publication Data

US 2022/0381475 A1 Dec. 1, 2022

(30) Foreign Application Priority Data

Dec. 17, 2019 (CN) ..... 201911307941.9
Dec. 17, 2019 (CN) ..... 201911313563.5
(Continued)

(51) Int. Cl.
*F24F 13/32* (2006.01)
*E04G 3/18* (2006.01)
*F24F 1/031* (2019.01)

(52) U.S. Cl.
CPC ..... *F24F 13/32* (2013.01); *E04G 3/18* (2013.01); *F24F 1/031* (2019.02)

(58) Field of Classification Search
CPC .. F24F 13/32; F24F 1/031; F24F 1/027; F24F 2221/20; F24F 1/03; E04G 3/18; E06B 7/03
See application file for complete search history.

(56) References Cited

U.S. PATENT DOCUMENTS 2,320,436 A * 6/1943 Hull ..... F24F 1/60 62/262
2,436,713 A * 2/1948 Cody ..... F24F 13/32 62/262
(Continued)

FOREIGN PATENT DOCUMENTS

CN 201476251 U 5/2010
CN 203771576 U 8/2014
(Continued)

OTHER PUBLICATIONS

World Intellectual Property Organization (WIPO) International Search Report and Written opinion for PCT/CN2020/079313 Sep. 25, 2020 18 Pages (Translation Included).
(Continued)

*Primary Examiner* — Eret C McNichols
(74) *Attorney, Agent, or Firm* — Anova Law Group, PLLC

(57) ABSTRACT

A mounting bracket assembly includes a support plate and an outdoor support. The support plate includes an outer support member. A mounting slide groove is formed at the outer support member and extending in a length direction of
(Continued)

the support plate. One end of the outdoor support is slidably provided in the mounting slide groove. A limit structure is provided between the one end of the outdoor support and the mounting slide groove and configured to limit the one end of the outdoor support from separating from the mounting slide groove.

20 Claims, 16 Drawing Sheets

(30) Foreign Application Priority Data

Dec. 17, 2019 (CN) ..... 201922279647.3
Dec. 17, 2019 (CN) ..... 201922279648.8
Dec. 17, 2019 (CN) ..... 201922290000.0
Dec. 17, 2019 (CN) ..... 201922294508.8

(56) References Cited

U.S. PATENT DOCUMENTS 2,568,968 A * 9/1951 Perrin ..... E04G 3/18 248/236
2,604,763 A * 7/1952 Lipman ..... F24F 1/027 62/262
2,608,148 A * 8/1952 Shapiro ..... F24F 13/32 454/204
2,814,244 A * 11/1957 Hord ..... F24F 1/04 454/203
2,818,793 A * 1/1958 Hord ..... F24F 1/04 454/203
2,925,026 A * 2/1960 Schuster ..... F24F 1/04 454/203
2,935,284 A * 5/1960 Reeves ..... F24F 13/32 248/208
3,030,873 A * 4/1962 Metcalfe ..... F24F 1/04 454/203
3,134,319 A * 5/1964 Marsteller ..... F24F 13/20 454/203
3,394,910 A * 7/1968 Ulich ..... F24F 13/00 248/236
3,476,033 A * 11/1969 Appel ..... F24F 13/20 62/262
3,481,264 A * 12/1969 Ulich ..... F24F 1/04 454/203
3,491,549 A * 1/1970 Oglesby ..... F24F 13/00 62/262
3,552,470 A * 1/1971 Metcalfe ..... F24F 1/04 454/204
3,554,476 A * 1/1971 Gaylor, Jr. ..... F24F 13/32 248/291.1
3,911,803 A * 10/1975 Kong ..... E06B 7/03 62/262
5,027,614 A * 7/1991 Mori ..... F24F 13/32 62/262
5,253,485 A * 10/1993 Kennedy ..... F24F 1/027 62/262
5,365,992 A * 11/1994 Swain ..... F24F 13/32 62/262
5,582,025 A * 12/1996 Dubin ..... F24F 13/32 62/262
5,979,533 A * 11/1999 Dupuie ..... F24F 1/0003 160/84.06
6,767,278 B1 * 7/2004 Peterson ..... F24F 1/027 248/200.1
7,121,105 B1 * 10/2006 Rais ..... F24F 1/027 62/262
7,296,424 B2 * 11/2007 Thompson ..... F24F 1/027 62/262
7,350,759 B1 * 4/2008 Gray ..... F24F 1/027 248/644
7,753,334 B2 * 7/2010 Schreiber ..... E04G 21/3261 182/60
7,975,441 B2 * 7/2011 McCarriston ..... F24F 1/027 62/262
8,104,240 B2 * 1/2012 McCarriston ..... F24F 1/027 62/262
8,584,998 B1 * 11/2013 Peterson ..... F24F 13/32 182/62
9,163,854 B2 * 10/2015 Arbucci ..... E04B 1/388
9,447,916 B2 * 9/2016 Darby ..... F24F 13/32
9,605,870 B2 * 3/2017 Darby ..... F24F 13/32
9,938,044 B2 * 4/2018 Gamboa ..... B65D 85/68
10,295,221 B2 * 5/2019 Zhang ..... F16M 13/02
10,401,043 B2 * 9/2019 Li ..... F24F 1/02
10,520,206 B2 * 12/2019 Xu ..... F24F 13/12
2003/0097854 A1 * 5/2003 Cur ..... F24F 1/027 62/262
2003/0110789 A1 * 6/2003 Cur ..... F24F 1/027 62/262
2007/0023592 A1 * 2/2007 Makoso ..... E06B 7/28 248/200.1
2007/0068185 A1 * 3/2007 Thompson ..... F24F 1/027 62/262
2007/0107329 A1 * 5/2007 Ferrara ..... E06B 9/04 52/203
2007/0137237 A1 * 6/2007 Rais ..... F24F 1/027 62/262
2014/0020421 A1 * 1/2014 Gallo ..... B23P 11/00 62/263
2014/0090334 A1 * 4/2014 Darby ..... E04G 3/18 52/741.1
2015/0097096 A1 * 4/2015 Arbucci ..... E04G 3/18 52/741.1
2017/0191763 A1 * 7/2017 Xu ..... F24F 1/027
2017/0297768 A1 * 10/2017 Gamboa ..... B65D 21/086
2017/0328596 A1 * 11/2017 Darby ..... F24F 13/32
2018/0023842 A1 * 1/2018 Gardikis, Sr ..... F16M 13/02 248/674
2019/0056143 A1 * 2/2019 Zhang ..... F24F 13/32
2019/0063760 A1 * 2/2019 Li ..... F24F 1/62
2020/0124296 A1 * 4/2020 Baumann ..... F24F 1/027
2020/0248911 A1 * 8/2020 Lei ..... F24F 13/32
2021/0010688 A1 * 1/2021 Biasotti ..... F24F 13/20
2021/0088251 A1 * 3/2021 Martinez Galvan .. F24F 1/0003
2021/0180828 A1 * 6/2021 Xing ..... F16M 13/022
2023/0026722 A1 * 1/2023 Yu ..... F24F 13/32
2023/0213215 A1 * 7/2023 DeRossett ..... F24F 13/32 62/262
2023/0375222 A1 * 11/2023 Leezer ..... F24F 1/027

FOREIGN PATENT DOCUMENTS

CN 104422116 A 3/2015
CN 107940615 A 4/2018
CN 108645004 A 10/2018
CN 208075293 U 11/2018
CN 208606292 U 3/2019
CN 208671324 U 3/2019
CN 208804781 U 4/2019
CN 209689082 U 11/2019
CN 211261058 U 8/2020
CN 211261059 U 8/2020
GB 1088701 A 10/1967
JP H0688466 A 3/1994
WO 9715218 A1 5/1997

OTHER PUBLICATIONS

China National Intellectual Property Administration (CNIPA) Office Action 1 for Application No. 201911313563.5 Oct. 24, 2024 13 Pages (including translation).

* cited by examiner

MOUNTING BRACKET ASSEMBLY AND WINDOW AIR CONDITIONER ASSEMBLY

CROSS-REFERENCE TO RELATED APPLICATIONS

The present application is a National Stage Entry under 35 U.S.C. § 371 of International Application No. PCT/CN2020/079313, filed on Mar. 13, 2020, which claims priority to Chinese Application No. 201911313563.5 titled "connector, support, mounting bracket assembly and window air conditioner assembly," Chinese Application No. 201911307941.9 titled "mounting bracket assembly and window air conditioner assembly," Chinese Application No. 201922279648.8 tilted "mounting case, mounting bracket assembly and window air conditioner assembly," Chinese Application No. 201922294508.8 tilted "support foot, mounting bracket assembly and window air conditioner assembly," Chinese Application No. 201922290000.0 titled "mounting bracket assembly and window air conditioner assembly," and Chinese Application No. 201922279647.3 titled "transverse fixation member, mounting bracket assembly and window air conditioner assembly," all filed on Dec. 17, 2021, the entire contents of all of which are incorporated herein by reference.

TECHNICAL FIELD

The present application relates to the technical field of mounting air conditioners, in particular to a mounting bracket assembly and a window air conditioner assembly.

BACKGROUND

In the related art, when to mount the window air conditioner, it is usually to arrange a support plate extending along a length direction of the window air conditioner at the bottom of the window air conditioner. Specifically, one end of the support plate is provided above the windowsill, the other end of the support plate is extended out of the window to support the outdoor part of the window air conditioner. The portion extending out of the window is an outer support member.

It is also usually to arrange the outdoor inclined support, the upper end of the inclined outdoor support is connected with the outer support member, and the lower end of the outdoor support is fixed on the outer surface of the wall to further support the outdoor part of the window air conditioner.

However, since the outdoor support and the support plate are two relatively independent portions, the operator needs to hold the outdoor support to install it with the outer support member all the time during mounting, which makes the mounting of the outdoor support very troublesome.

SUMMARY

The main purpose of the present application is to propose a mounting bracket assembly, aiming at solving a technical problem of inconvenience of installing the outdoor support and outer support member.

In order to achieve the above purpose, the present application proposes a mounting bracket assembly, configured to mount a window air conditioner, comprising:

a support plate configured to be provided at a bottom of the window air conditioner; the support plate comprising an outer support member extending out of a room to support an outdoor part of the window air conditioner; a mounting slide groove being formed below the outer support member and extending in a length direction of the support plate; and an outdoor support having an end slidably provided in the mounting slide groove; a limit structure being provided between the end of the outdoor support and the mounting slide groove for limiting the end of the outdoor support from separating from the mounting slide groove; the outdoor support having another end abutting against the wall.

Optionally, each of two opposite edges of the outer support member is provided with a first flange extending downward, and the mounting slide groove is formed between two first flanges and the outer support member.

Optionally, a lower edge of at least one of the first flanges is provided with a limit flange extending towards the other one of the first flanges; one end of the outdoor support is provided with a limit lug protruding towards the first flange; the limit lug is provided above the limit flange; the limit lug is limited by the limit flange for avoiding separating from the mounting slide groove.

Optionally, one end of the outdoor support is provided at the outer support member and adjustable in the length direction of the support plate.

Optionally, the outer support member is provided with a plurality of mounting positions provided at intervals in the length direction of the support plate, and one end of the outdoor support is selectively cooperated and connected with one of the plurality of the mounting positions.

Optionally, the first flange is provided with a plurality of first through holes provided at intervals in the length direction of the support plate, and two first through holes directly opposite to two first flanges define the mounting position.

Optionally, one end of the outdoor support is provided with a second through hole connected with the first through hole.

Optionally, an end face of one end of the outdoor support abuts against a lower surface of the outer support.

Optionally, the outdoor support is an outdoor inclined support, the outdoor inclined support comprises an inclined bottom plate and two inclined side plates provided at two opposite sides of the inclined bottom plate, and the limit lug is provided at the inclined side plate.

Optionally, the limit lug is a folding structure provided at a side edge of the inclined side plate.

Optionally, an upper end of the side edge of the inclined side plate is provided with an anti-rotation convex protruding towards the wall, and the anti-rotation part abuts against the lower surface of the outer support part.

Optionally, the another end of the outdoor support is provided with a support foot, the support foot comprises a rotation member and a damping member; the rotation member has a rotation connection position to be configured to rotatably connect to the another end of the outdoor support, and the rotation connection position is provided close to an upper end of the rotation member; the rotation member has a resistance action surface facing the wall; the damping member is provided at the resistance action surface, and the damping member abuts against the wall.

Optionally, the rotation member comprises a rotation bottom plate and two rotation side plates provided at two opposite sides of the rotation bottom plate; the resistance action surface is a bottom surface of the rotation bottom plate, and the rotation connection position is provided at the rotation side plate and close to an upper end of the rotation side plate.

Optionally, the rotation connection position is a first rotation hole passing through the rotation side plate; and/or, a width of the rotation side plate gradually decreases from top to bottom.

Optionally, the mounting bracket assembly further comprises a transverse fixation member connected with the end of the support plate, and the transverse fixation member is configured to fixedly abut against an inner surface of a window frame;

the transverse fixation member comprises a transverse limit member; the transverse limit member comprises a limit top plate, a first limit side plate, a second limit side plate and two limit bottom plates, and the first limit side plate and the second limit side plate are respectively provided at two opposite side edges of the limit top plate; a length of the first limit side plate is greater than that of the second limit side plate, and the two limit bottom plates are respectively provided at both ends of the first limit side plate; the limit bottom plates are provided opposite to the limit top plate; the limit top plate, the first limit side plate, the second limit side plate and the limit bottom plates are enclosed to form a mounting space, a first opening communicated with the mounting space is formed between the two limit bottom plates, and a second opening communicated with the mounting space is formed between the limit bottom plates and the limit top plate where the second limit plate is located.

Optionally, the limit bottom plates and the second limit side plate are provided at intervals in a length direction of the transverse limit member to form a third opening communicated with the mounting space and located between the second limit side plate and the second opening.

Optionally, the transverse fixation member further comprises two transverse extension members, and the transverse extension members are slidably mounted in the mounting space in the length direction of the transverse limit member to adjust a length of the transverse fixation member.

Optionally, the transverse extension member comprises an extension bottom plate, a first extension side plate and a second extension side plate; the first extension side plate and the second extension side plate are respectively provided at two opposite side edges of the extension bottom plate; the extension bottom plate is provided opposite to the limit top plate; the first extension side plate is provided adjacent to the first limit side plate, and the second extension side plate is provided adjacent to the second limit side plate.

Optionally, the transverse limit member is provided with a plurality of first mounting positions provided at intervals in the length direction of the transverse limit member, and the transverse extension member is provided with a second mounting position connected with the first mounting position and cooperated with the first mounting position.

Optionally, the first mounting position is a first connection hole provided at the first limit side plate of the transverse limit member and passing through the first limit side plate, and the second mounting position is a second connection hole provided at the first extension side plate of the transverse extension member and passing through the first extension side plate. Optionally, the mounting bracket assembly has a level mounting member protruding away from the window frame, the mounting bracket assembly further comprises a mounting case configured to mount a level on the level mounting member, and the mounting case is detachably connected with the level mounting member;

the mounting case has an accommodation cavity configured to mount the level, and a top of the mounting case is provided with a visible notch communicated with the accommodation cavity; the mounting case is also provided with a detachable connection structure detachably connected with the level mounting member.

Optionally, the detachable connection structure is a clamp structure clamping with the level mounting member.

Optionally, the clamp structure comprises two elastic clamp arms provided at two opposite sides of the mounting case; a lower end of each elastic clamp arm protrudes downward from a bottom of the mounting case, and the lower end of each elastic clamp arm is provided with a clamp convex protruding towards the other elastic clamp arm;

the level mounting member is a level mounting plate, a bottom of the mounting case abuts against an upper surface of the level mounting plate, and the clamp convex is provided below the level mounting plate and clamped to a lower surface of the level mounting plate.

Optionally, a bottom of the mounting case is provided with a mounting opening communicated with the accommodation cavity; the accommodation cavity comprises a top wall surface opposite to the mounting opening and two side wall surfaces connected with two opposite sides of the top wall surface; a limit convex is protruded from each side wall surface, and the limit convex is configured to retain the level between the limit convex and the top wall surface.

The present application also provides a window air conditioner assembly, comprising:

a mounting bracket assembly as mentioned above provided at a window of the wall; and the window air conditioner mounted at the mounting bracket assembly.

Optionally, the window air conditioner has a partition slot dividing the window air conditioner into an indoor part and an outdoor part, the mounting seat is movably mounted in the partition slot configured for shield member provided at the window extending into.

When the mounting bracket assembly in the embodiments of the application is being installed, the outdoor inclined support can be limited in the mounting slide groove through the limit structure (such as the interaction between the limit flange and the limit convex), so as to prevent the outdoor inclined support from falling off from the mounting slide groove. On the one hand, the installer does not need to hold the outdoor inclined support all the time, so as to reduce the mounting difficulty of the outdoor inclined support; on the other hand, it can also avoid the accidental falling of the outdoor inclined support, so as to improve the mounting safety.

BRIEF DESCRIPTION OF THE DRAWINGS

In order to more clearly explain the embodiments of the present application or the technical solutions in the related art, the following will briefly introduce the drawings in the embodiments or the description of the related art. It is obvious that the drawings in the following description are only some embodiments of the present application. For those skilled in the art, other drawings can be obtained according to the structure shown in these drawings without paying creative labor.

DESCRIPTION OF REFERENCE NUMERALS

Figure 1:
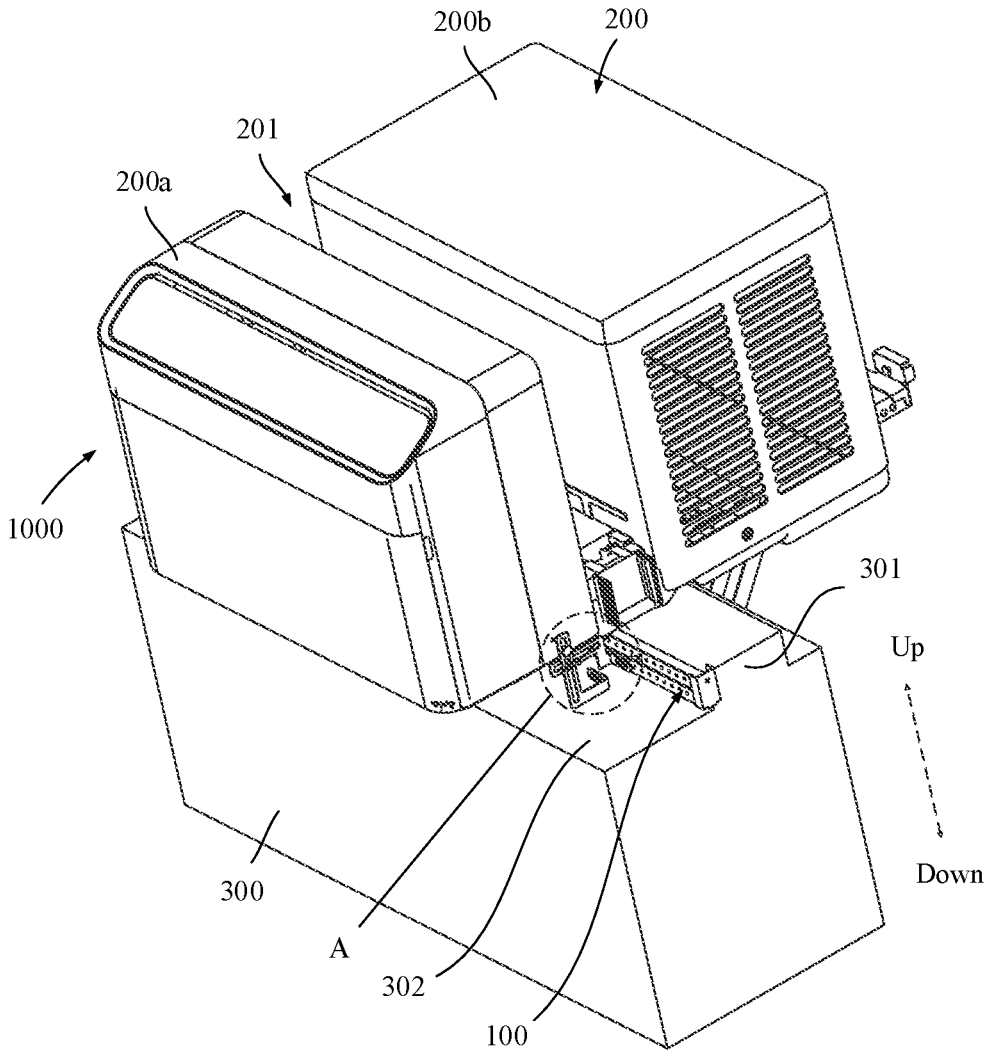
FIG. 1 is a structural view of an embodiment in which the window air conditioner assembly of the present application is mounted at the window.

100. mounting bracket assembly; 10. support frame; 11. support plate; 111. inner support member; 1111. second flange; 112. middle connection member; 1121. third flange; 113. outer support member; 1131. first flange; 1132. mounting slide groove; 1133. first through hole; 1134. limit flange; 114. the first folding abutment member; 1. transverse fixation member; 12. transverse limit member; 121. limit top plate; 122. the first limit side plate; 1221. first connection hole; 123. second limit side plate; 124. limit bottom plate; 125. first opening; 126. second opening; 127. third opening; 13. transverse extension member; 131. extension bottom plate; 132. the first extension side plate; 1322. the third connection hole; 133. the second extension side plate; 1331. the fifth connection hole; 1332. the sixth connection hole; 134. extension mounting member; 1341. extension mounting plate; 1342. extension reinforcement plate; 14. transverse connection plate; 141. the second folding abutment member; 142. the first folding plate; 143. second folding plate; 15. level mounting plate; 151. clamp notch; 20. connector; 21. first support; 211. the first connection through hole; 212. vertical support plate; 213. horizontal abutment plate; 214. side abutment plate; 22. second support; 221. second connection through hole; 222. horizontal support plate; 223. vertical connection plate; 224. horizontal connection plate; 225. the fourth connection hole; 30. outdoor inclined support; 31. inclined bottom plate; 311. avoidance notch; 32. inclined side plate; 321. anti-rotation convex; 322. limit lug; 40. support foot; 41. rotation member; 411. rotation bottom plate; 4111. damping through hole; 412. rotation side plate; 4121. first rotation hole; 42. damping member; 421. damping pad; 4211. damping convex; 4212. non-slip groove; 422. pad connection member; 43. rotation shaft; 50. mounting case; 51. accommodation cavity; 511. top wall surface; 512. side wall surface; 513. limit convex; 5131. limit surface; 5132. guide surface; 52. visible notch; 53. elastic clamp arm; 531. horizontal arm; 532. vertical arm; 54. clamp convex; 55. mounting opening; 56. end through hole; 60. level; 200. window air conditioner; 200*a*. indoor part; 200*b*. outdoor part; 201. partition slot; 202. preset connection position; 300. wall; 301. window frame; 302. windowsill; 1000. window air conditioner assembly.

The realization of the purpose, functional features and advantages of the present application will be further described with reference to the attached drawings in combination with the embodiments.

DETAILED DESCRIPTION OF THE EMBODIMENTS

The technical scheme in the embodiments of the present application will be clearly and completely described below in combination with the attached drawings in the embodiments of the present application. Obviously, the described embodiments are only portion of the embodiments of the present application, not all of the embodiments. Based on the embodiments in the present application, all other embodiments obtained by those skilled in the art without creative work belong to the protection scope of the present application.

It should be noted that if there is a description of "first," "second" and the like in the embodiments of the present application, the description of "first," "second" and the like is only for the purpose of description, and cannot be understood as indicating or implying its relative importance or implicitly indicating the number of indicated technical features. Thus, a feature associated with "first" and "second" may include at least one of the feature explicitly or implicitly.

In addition, the meaning of "and/or" in the full text is that it includes three parallel schemes. Taking "A and/or B" as an example, it includes scheme A, or scheme B, or both schemes A and B.

The present application proposes a mounting bracket assembly and a window air conditioner assembly, as shown in FIGS. 1-25. The window air conditioner assembly 1000 includes a window air conditioner 200 and the mounting bracket assembly 100.

Figure 3:
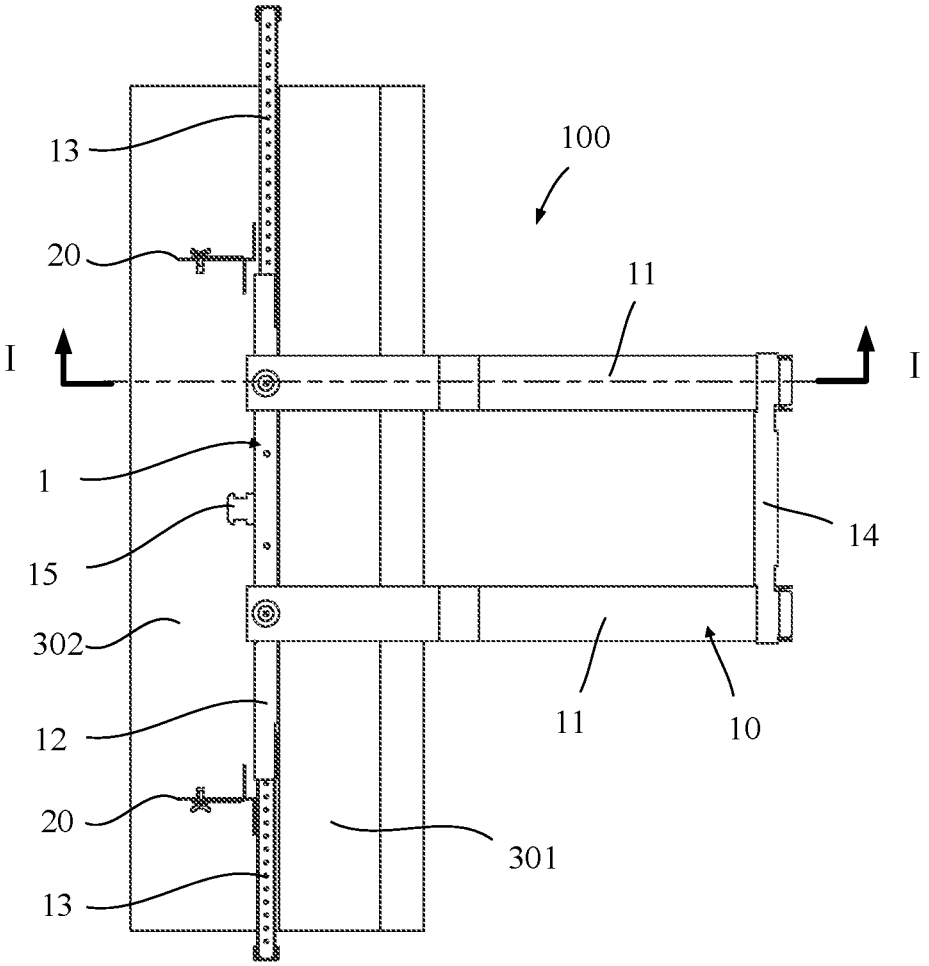
FIG. 3 is a top view of an embodiment in which a mounting bracket assembly of the present application is mounted at a window.
Figure 4:
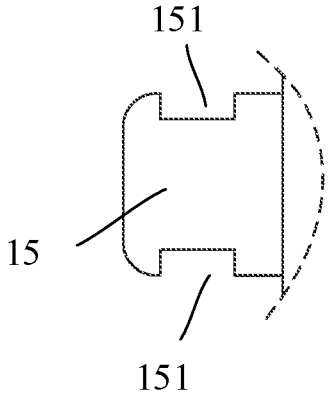
FIG. 4 is a partial enlarged view of a level mounting plate in FIG. 3.

As shown in FIGS. 1 and 3, the mounting bracket assembly 100 is mounted at a window of the wall 300 to support and fix a placement member on the wall 300. The placement member can be the window air conditioner 200, or the like. The window air conditioner 200 is taken as an example to be described as below. The window comprises a windowsill 302 provided with a window frame 301. A length direction of the windowsill 302 is a width direction of the window.

Figure 12:
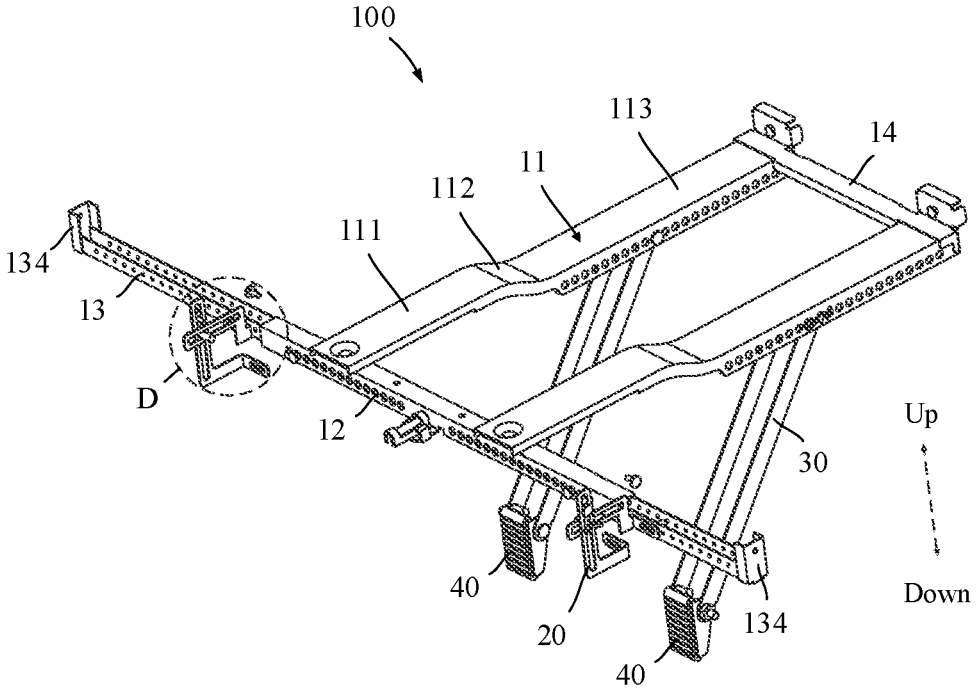
FIG. 12 is a three-dimensional structural view of the mounting bracket assembly in FIG. 3.
Figure 13:
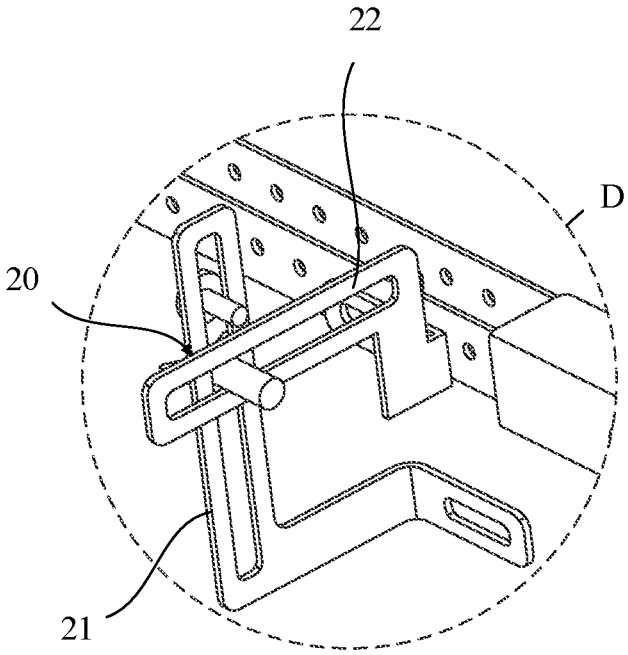
FIG. 13 is a partial enlarged view of portion D in FIG. 12.

As shown in FIGS. 3 and 12, the mounting bracket assembly 100 includes a support frame 10, a connector 20 and an outdoor support.

As shown in FIG. 1, the support frame 10 is (configured to be) provided at the bottom of the window air conditioner 200, one end of the support frame 10 is mounted at the inside of the window frame 301, and the other end of the support frame 10 is extended out of the room. Specifically, an inner end (an end facing indoor) of the support frame 10 is fixedly mounted at an inner side of the window frame 301, and an outer end (an end facing outdoor) of the support frame 10 is extended out of the window. As shown in FIG. 1, the window air conditioner 200 is placed on the support frame 10.

It should be noted that if the embodiments of the present application involves directional indication (such as up, down, left, right, front, back, inner, outer . . . ), the directional indication is only used to explain the relative position relationship and movement among components under a specific attitude (as shown in FIG. 1 and FIG. 12). If the specific attitude changes, the directional indication will change accordingly.

Further, as shown in FIG. 3 and FIG. 12, the support frame 10 includes a support plate 11 configured to be provided at a bottom of the window air conditioner, one end of the support plate 11 is provided at the windowsill 302, and the other end of the support plate 11 is extended out of the window. In this embodiment, the support plate 11 is extended in the length direction of the window air conditioner.

Specifically, as shown in FIG. 3 and FIG. 12, the support plate 11 includes an inner support member 111, an outer support member 113 and a middle connection member 112. The inner support member 111 is provided above the windowsill 302, the outer support member 113 is extended out to outdoor. The outer support member 113 is lower than the inner support member 111, and the middle connection member 112 connects the inner support member 111 and the outer support member 113. Specifically, the middle connection member 112 is provided obliquely, the inner support member 111 is connected with one end (i.e. an inner end) of the middle connection member 112 and is extended towards the indoor. The outer support member 113 is connected with the other end (i.e. an outer end) of the middle connection member 112 and is extended towards the outdoor.

In this embodiment, as shown in FIGS. 3, 5, 9 and 12, the inner support member 111 and the outer support member 113 are provided horizontally, the outer support member 113 is located below the inner support member 111, and the middle connection member 112 is provided obliquely to connect the inner support member 111 and the outer support member 113.

In this embodiment, as shown in FIG. 1, the window air conditioner 200 has a partition slot 201, which divides the window air conditioner 200 into an indoor part 200*a* and an outdoor part 200*b*. The partition slot 201 is provided above the inner support member 111, an outer end of the outdoor part 200*b* is provided at the outer support member 113, and an inner end of the outdoor part 200*b* is optionally provided at the inner support member 111. The partition slot 201 is used for the shield member provided at the window extending into.

Specifically, the window air conditioner includes a housing (not labeled in the figures), a compressor, an outdoor heat exchanger, an outdoor fan, an indoor heat exchanger and an indoor fan (not shown in the figures) provided inside the housing. The partition slot 201 is provided at the housing. The compressor, the outdoor heat exchanger and the outdoor fan are provided in the outdoor part 200*b*. The indoor heat exchanger and the indoor fan are provided in the indoor part 200*a*.

Further, as shown in FIG. 3 and FIG. 12, the support frame 10 also includes a transverse fixation member 1, the transverse fixation member 1 is extended in the length direction of the windowsill 302. The transverse fixation member 1 fixedly abuts against an inner surface of the window frame 301 (i.e. a side of the window frame 301 facing indoors), and the inner end of the support plate 11 is connected with the transverse fixation member 1 to fix the support plate 11. Specifically, the inner end of the inner support member 111 is connected with the transverse fixation member 1, and the bottom of the inner support member 111 abuts against the upper portion of the window frame 301. Optionally, the transverse fixation member 1 has an abutting surface abutting against the inner surface of the window frame 301.

In this way, since the transverse fixation member 1 fixedly abuts against the inner surface of the window frame 301, the support frame 10 can be fixedly connected with the window frame 301 and the wall 300, etc., so as to improve the mounting stability of the window air conditioner 200. Moreover, the transverse fixation member 1 and the support plate 11 can also form a step structure to quickly position when mounting the support frame 10.

Specifically, the transverse fixation member 1 is provided below the window air conditioner 200.

Optionally, the inner end of the inner support member 111 is connected with the transverse fixation member 1 through a screw locking structure.

In a specific embodiment, there are many structural forms of the transverse fixation member 1, such as block, plate, or tube, etc. At the same time, the transverse fixation member 1 can be an integral portion or an assembly. The following takes the transverse fixation member 1 being an assembly as an example.

Further, as shown in FIGS. 3, 12, 18 and 24, the transverse fixation member 1 includes a transverse limit member 12 extending in the length direction of the windowsill 302, the transverse limit member 12 fixedly abuts against an inner surface of the window frame 301. The inner end of the support plate 11 is connected with the transverse limit member 12 to fix the support plate 11.

Optionally, the transverse limit member 12 is provided below the indoor part 200*a* of the window air conditioner 200.

Optionally, the length of the transverse limit member 12 is equivalent to the width of the window air conditioner 200 (i.e. the length of the windowsill 302), that is, the length of the transverse limit member 12 can be slightly greater than the width of the window air conditioner 200, equal to the width of the window air conditioner 200, or slightly less than the width of the window air conditioner 200.

Further, as shown in FIGS. 3, 12, 18 and 24, the transverse fixation member 1 also includes two transverse extension members 13 provided at both ends of the transverse limit member 12. The transverse extension member 13 is extended in the length direction of the windowsill 302, and one end of the transverse extension member 13 away from the transverse limit member 12 is connected with the side wall of the window to make the transverse limit member 12 and the transverse fixation member 1 fixedly abut against the inner surface of the window frame 301. In this way, the mounting stability of the support frame 10 can be guaranteed/improved.

Further, as shown in FIGS. 3, 12, 18 and 24, the transverse extension member 13 and the transverse limit member 12 are movably cooperated in the length direction of the windowsill 302, so that the length of the transverse fixation member 1 in the length direction of the windowsill 302 is adjustable. In this way, the support frame 10 can be suitable for windows with different widths, the scope of application of the support frame 10 and the mounting bracket assembly 100 is expanded, and the universality of the support frame 10 and the mounting bracket assembly 100 is improved.

Further, the transverse limit member 12 is provided with a plurality of first mounting positions provided at intervals in the length direction of the windowsill 302, and the transverse extension member 13 is provided with a second mounting position cooperated and connected with the first mounting positions. In this way, the reliable cooperation between the transverse limit member 12 and the transverse extension member 13 can be ensured. It can be understood that the second mounting position can be selectively cooperated and connected with one of the first mounting positions, so that the length of the transverse fixation member 1 in the length direction of the windowsill 302 can be adjusted.

Figure 24:
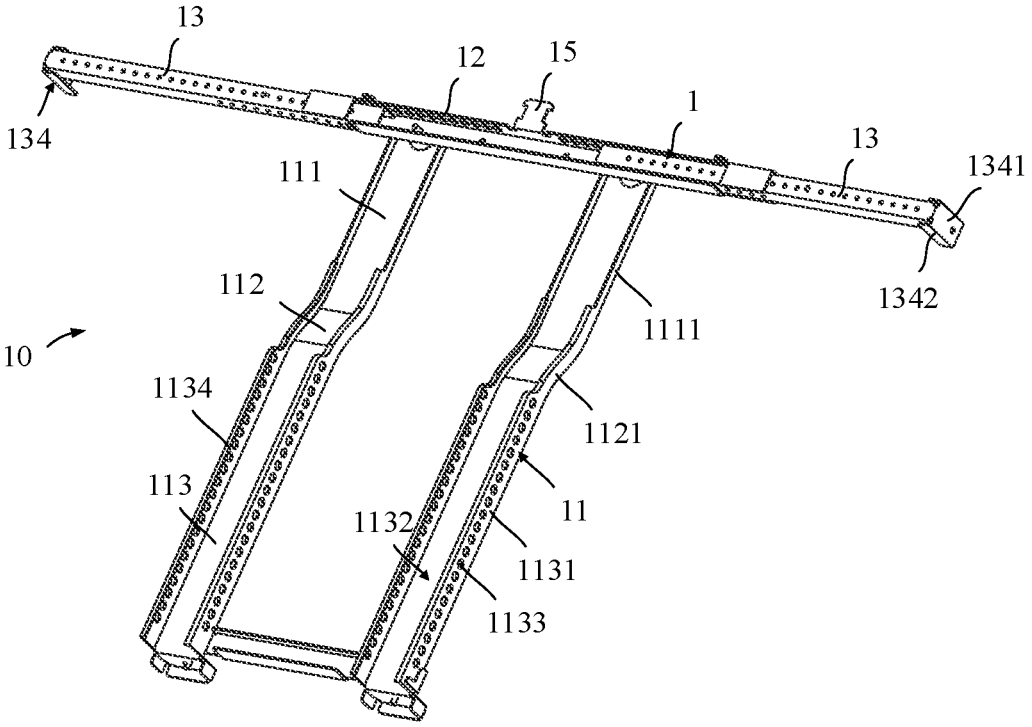
FIG. 24 is a structural view of a support frame in FIG. 12.

In this embodiment, as shown in FIG. 24, the transverse limit member 12 is provided in a tubular shape, and the transverse extension member 13 is slidably mounted in the transverse limit member 12.

Figure 25:
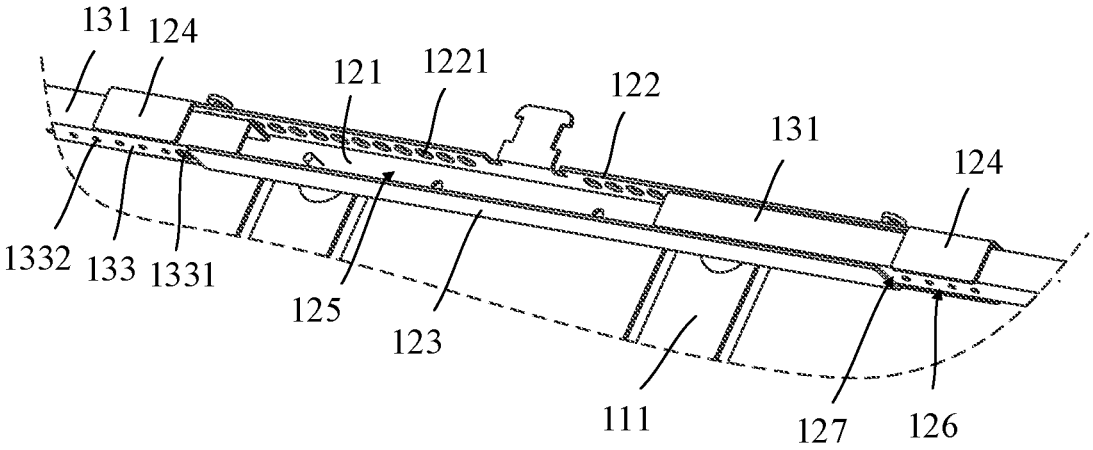
FIG. 25 is a partial enlarged view of the transverse limit member in FIG. 24.

Further, as shown in FIGS. 24 and 25, the transverse limit member 12 includes a limit top plate 121, a first limit side plate 122, a second limit side plate 123 and two limit bottom plates 124.

As shown in FIG. 12, the limit top plate 121 is set upward.

As shown in FIGS. 24 and 25, the first limit side plate 122 and the second limit side plate 123 are respectively provided at the two opposite sides of the limit top plate 121. The length of the first limit side plate 122 is greater than that of the second limit side plate 123, and two excess portions are formed at both ends of the first limit side plate 122, which protrude from the first limit side plate 122 in the length direction of the windowsill 302. The first mounting position can be provided at the first limit side plate 122 or the second limit side plate 123.

As shown in FIGS. 24 and 25, the two limit bottom plates 124 are respectively provided at both ends of the first limit side plate 122, and the limit bottom plate 124 is provided opposite to the limit top plate 121. Optionally, the limit bottom plates 124 is provided at the excess portions.

The limit top plate 121, the first limit side plate 122, the second limit side plate 123 and the limit bottom plates 124 form a mounting space. A first opening 125 communicated with the mounting space is formed between the two limit bottom plates 124, and a second opening 126 communicated with the mounting space is formed between the limit bottom plate 124 and the limit top plate 121 where the second limit side plate 123 is located.

The transverse limit member 12 can be a stamping piece.

As shown in FIGS. 12, 16, 24 and 25, the transverse extension member 13 includes an extension bottom plate 131, a first extension side plate 132 and a second extension side plate 133, the first extension side plate 132 and the second extension side plate 133 are respectively provided at two opposite sides of the extension bottom plate 131.

The transverse extension member 13 is slidably mounted in the mounting space, the extension bottom plate 131 is provided opposite to the limit top plate 121, the first extension side plate 132 is provided adjacent to the first limit side plate 122, and the second extension side plate 133 is provided adjacent to the second limit side plate 123.

In this way, through the above settings, the first opening and the second opening can be formed on the transverse limit member 12. When stamping the transverse limit member 12, it is convenient to design and produce the mold, so as to reduce the production difficulty of the transverse limit member 12, thereby realizing mass production, reducing the production cost and saving materials. The structural strength of the transverse limit member 12 can also be ensured to ensure/improve the support effect of the window air conditioner.

At the same time, by forming a second opening 126 on the transverse limit member 12, it is easy to guide the transverse extension member 13 to be inserted into the mounting space, so as to reduce the mounting difficulty of the transverse fixation member. Moreover, by forming the first opening 125 and the second opening 126 on the transverse limit member 12, the friction between the transverse extension member 13 and the transverse limit member 12 can be reduced to facilitate the sliding of the transverse extension member 13 in the mounting space.

In addition, through the above setting, the structure of the transverse extension member 13 can be simplified, and by setting the extension bottom plate 131 opposite to the limit top plate 121, the connection strength between the transverse limit member 12 and the transverse extension member 13 can be improved.

Further, as shown in FIG. 25, the limit bottom plate 124 and the second limit side plate 123 are provided at intervals in the length direction of the windowsill 302 (i.e. the length direction of the transverse limit member 12) to form a third opening 127 communicated with the mounting space between the second limit side plate 123 and the second opening 126. In this way, the friction between the transverse extension member 13 and the transverse limit member 12 can be reduced to facilitate the insertion of the transverse extension member 13 into the mounting space.

In addition, since the first opening 125, the second opening 126 and the third opening 127 are provided, it is convenient to realize molding to realize mass production.

Further, as shown in FIG. 25, the transverse limit member 12 is an integral bended structure.

Further, as shown in FIGS. 12, 16, 24 and 25, the first mounting position is a first connection hole 1221 provided at the first limit side plate 122 and passing through the first limit side plate 122, and the second mounting position is a second connection hole provided at the first extension side plate 132 and passing through the first extension side plate 132.

Fixation members (such as screws or pins) successively pass the first connection hole 1221 and the second connection hole to connect the first limit side plate 122 and the first extension side plate 132 to ensure the stability of the length of the transverse fixation member 1, so as to ensure the reliability of the support frame 10.

Optionally, the first limit side plate 122 is provided towards the indoor. The second limit side plate 123 abuts against the inner surface of the window frame 301, and the limit bottom plate 124 is provided towards the surface of the windowsill 302. Optionally, the limit bottom plate 124 abuts against the surface of the windowsill 302.

Figure 16:
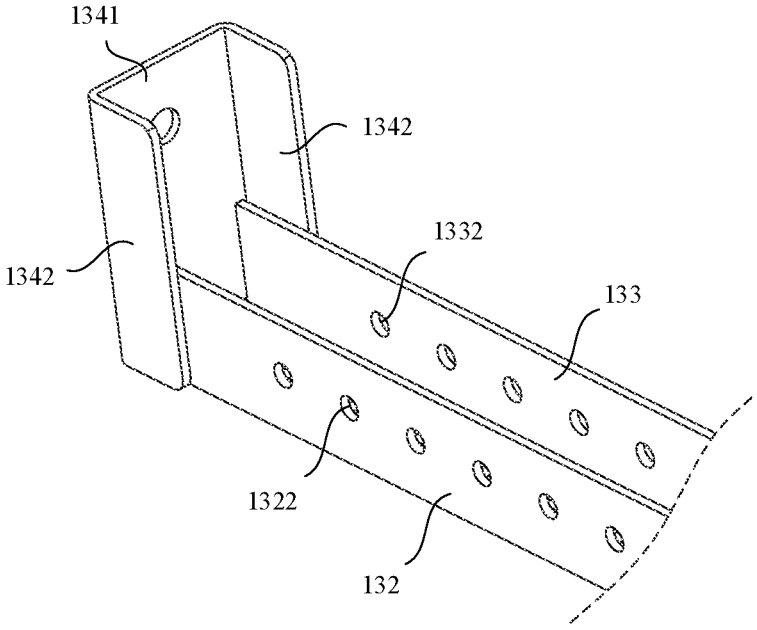
FIG. 16 is a partial enlarged view of a left end of a transverse extension member in FIG. 12.
Figure 17:
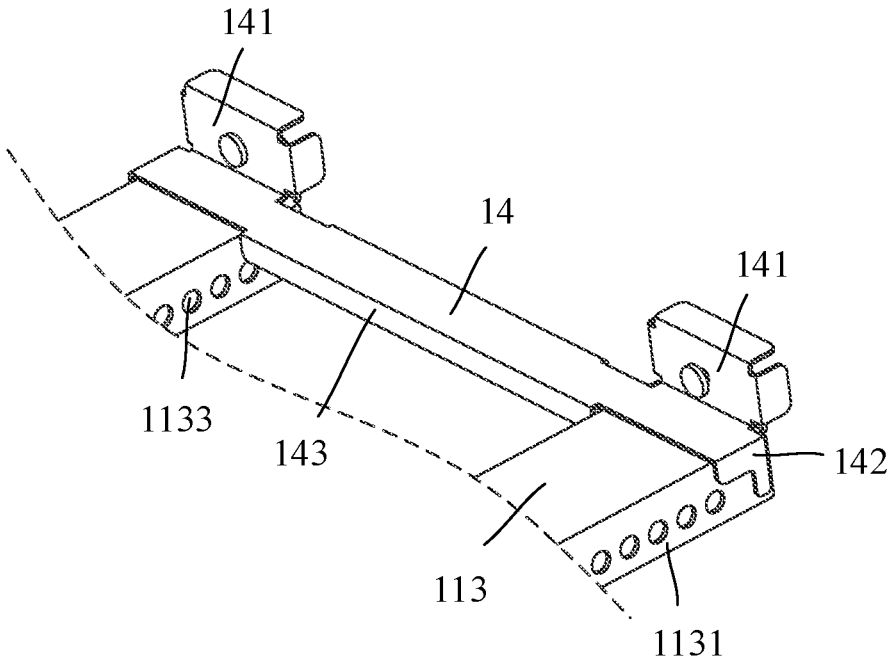
FIG. 17 is a partial enlarged view of a transverse connection plate in FIG. 12.
Figure 18:
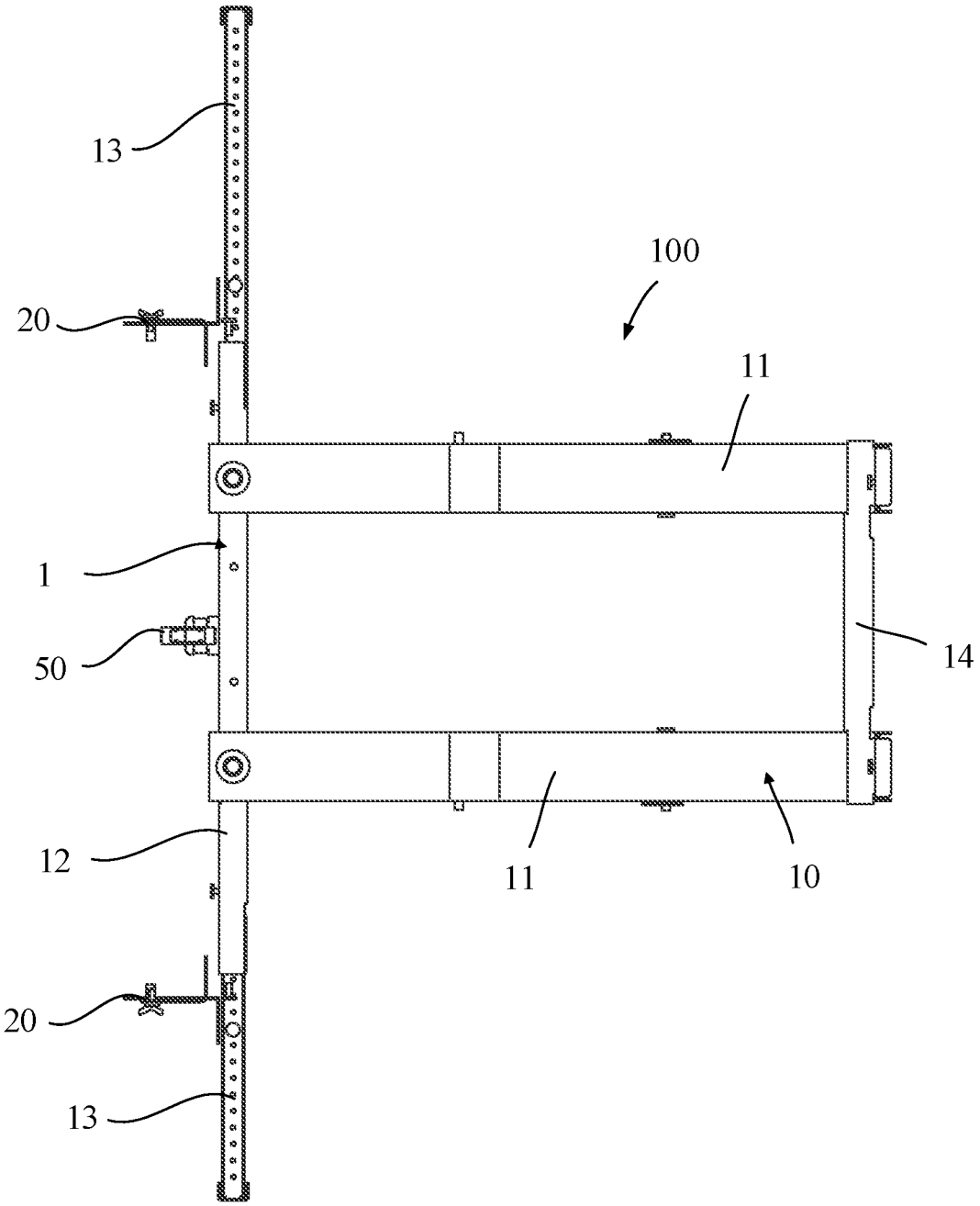
FIG. 18 is a top view of the mounting bracket assembly in FIG. 12.

Further, as shown in FIGS. 16 and 24, the transverse extension member 13 also includes an extension mounting member 134, the extension mounting member 134 is provided at one end of the extension bottom plate 131 away from the transverse limit member 12, and the extension mounting member 134 is connected with the side wall of the window. In this way, since the extension mounting member 134 is provided, the transverse extension member 13 can be fixed on the side wall of the window, so that the transverse fixation member 1 can fixedly abuts against the inner surface of the window frame 301.

As shown in FIGS. 16 and 24, the extension mounting member 134 includes an extension mounting plate 1341 bent and extended to a side from one end of the extension bottom plate 131 away from the transverse limit member 12, and the extension mounting plate 1341 is connected with the side wall of the window.

Optionally, the extension mounting plate 1341 is provided with a connection through hole (not labeled in the figures), and a fixation member (a screw or the like) (not labeled in the figures) passes through the connection through hole and are threaded with the side wall of the window. The connection through hole can be optionally a threaded hole to improve the connection strength and connection stability.

Optionally, the extension mounting plate 1341 and the extension side plate are located on the same side of the extension bottom plate 131.

Further, as shown in FIGS. 16 and 24, the extension mounting member 134 also includes two extension reinforcement plates 1342 provided at the two opposite side edges of the extension mounting plate 1341, and the extension reinforcement plate 1342 is provided at the inner side or outer side of the extension side plate. In this way, the structural strength of the extension mounting member 134 can be enhanced to enhance the connection stability between the extension mounting member 134 and the side wall of the window.

Optionally, the extension reinforcement plate 1342 is provided at the outer side of the extension side plate.

Optionally, the extension reinforcement plate 1342 is fixedly connected with the extension side plate (such as welding, or threaded structure connection, etc.).

Figure 2:
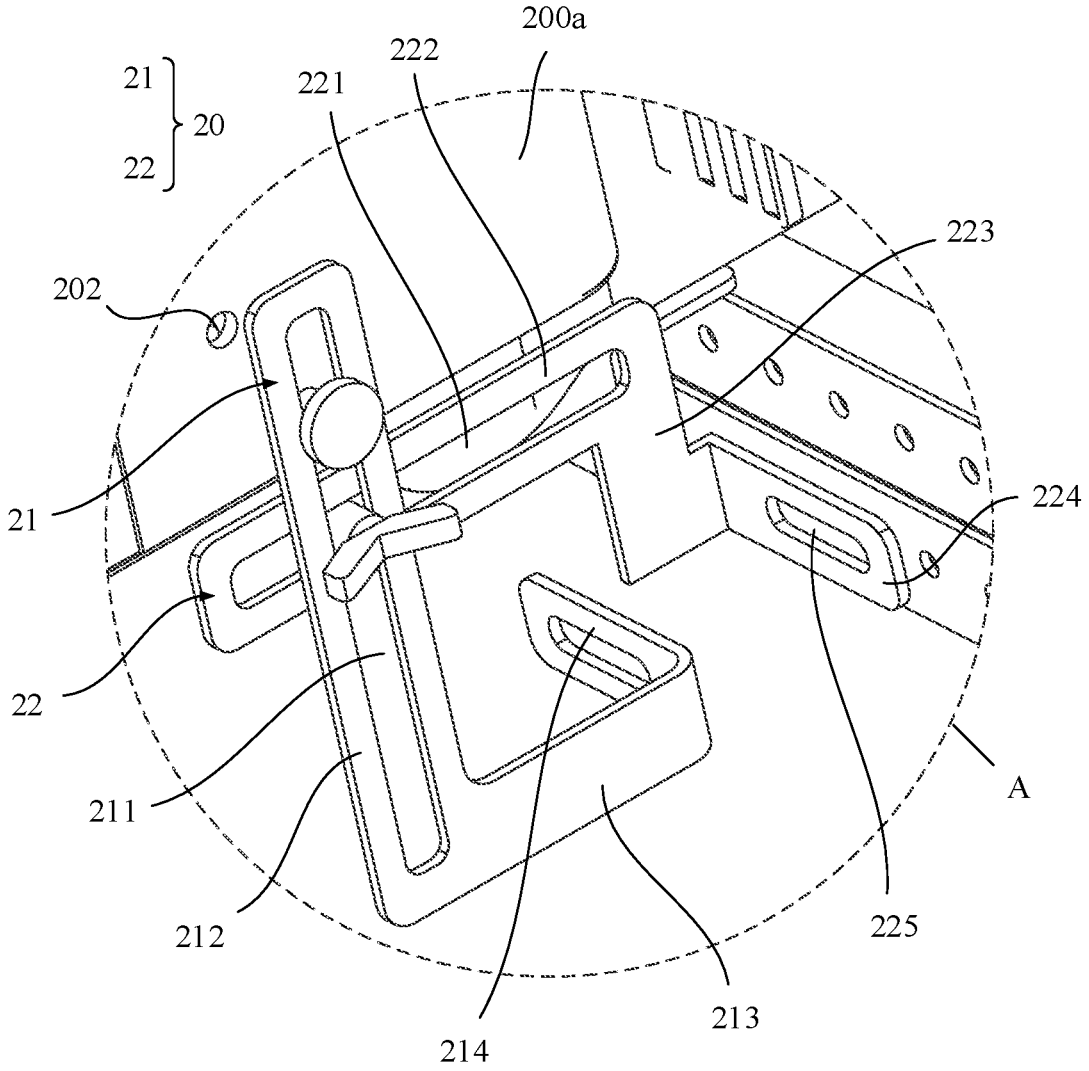
FIG. 2 is a partial enlarged view of portion Ain FIG. 1.

Further, as shown in FIGS. 1, 2 and 12, the connector 20 is provided at the window, and the upper end of the connector 20 is connected with the window air conditioner 200. The connector 20 is connected with the support frame 10 or the window frame 301, and/or the lower end of the connector (20) is used to abut against the surface of the windowsill 302. That is, 1) in some embodiments, the upper end of the connector 20 can be connected with the window air conditioner 200, and the lower end of the connector 20 can abut against the surface of the windowsill 302; 2) in some embodiments, the connector 20 can be connected with the inner end of the support frame 10 or the window frame 301, and the upper end of the connector 20 can be connected with the window air conditioner 200; 3) in some embodiments, the connector 20 can be mounted at the inner end of the support frame 10 or on the window frame 301, the upper end of the connector 20 can be connected with the side of the window air conditioner 200, and the lower end of the connector 20 can abut against the surface of the windowsill 302.

In a specific implementation, the connector 20 can be provided at the inner side of the window frame 301 (i.e. a side facing the indoor) or on the outer side of the window frame 301 (i.e. a side facing the outdoor).

When the connector 20 is provided at the inside of the window frame 301, for the scheme that the upper end of the connector 20 is connected with the window air conditioner 200, and the lower end of the connector 20 abuts against the surface of the windowsill 302, when the window air conditioner 200 is pressed down, the connector 20 can support the window air conditioner 200 to prevent the window air conditioner 200 from being pressed down and falling to indoor. In this way, the window air conditioner 200 can be prevented from being pressed down and falling to the indoor side, so as to improve the mounting stability of the window air conditioner 200. 2) For the scheme that the connector 20 is connected with the support frame 1 or the window frame 301, and the upper end of the connector 20 is connected with the window air conditioner 200, the mounting stability of the window air conditioner 200 can be improved. Specifically, the connector 20 can limit the window air conditioner 200. For example, when the window air conditioner 200 is lifted up, the connector 20 can pull the window air conditioner 200 to prevent the window air conditioner 200 from being lifted up and falling to the outdoor side. For another example, when the window air conditioner 200 is pressed down, the connector 20 can support the window air conditioner 200 to prevent the window air conditioner 200 from being pressed down and falling to the indoor side. That is, since the connector 20 is connected with the support frame 10 and the window air conditioner, it can not only prevent the window air conditioner 200 from being lifted up and falling to the outdoor side, but also prevent the window air conditioner 200 from being pressed down and falling to the indoor side. 3) For the scheme that the connector 20 is mounted at the inner end of the support frame 10 or the window frame 301, the upper end of the connector 20 is connected to the side of the window air conditioner 200, and the lower end of the connector 20 abuts against the surface of the windowsill 302, it can not only prevent the window air conditioner 200 from being lifted up and falling to the outdoor side, but also prevent the window air conditioner 200 from being pressed down and falling to the indoor side, and the effect of supporting the window air conditioner 200 when the window air conditioner 200 is pressed downward can be improved to further prevent the indoor part 200*a* of the window air conditioner 200 from being pressed downward and falling to the indoor side.

When the connector 20 is provided at the outer side of the window frame 301, 1) for the scheme that the upper end of the connector 20 is connected with the window air conditioner 200, and the lower end of the connector 20 abuts against the surface of the windowsill 302, the connector 20 can assist the support frame 10 to support the window air conditioner 200, so as to improve the mounting stability of the window air conditioner 200. 2) For the scheme that the connector 20 is connected with the support frame 1 or the window frame 301, and the upper end of the connector 20 is connected with the window air conditioner 200, the mounting stability of the window air conditioner 200 can be improved. Specifically, the connector 20 can limit the window air conditioner 200. For example, when the window air conditioner 200 is lifted up, the connector 20 can pull the window air conditioner 200 to prevent the window air conditioner 200 from being lifted up and falling to the indoor side. For another example, when the window air conditioner 200 is pressed downward, the connector 20 can pull the window air conditioner 200 to prevent the window air conditioner 200 from being pressed downward and falling to the indoor side. That is, since the connector 20 is connected with the support frame 10 and the window air conditioner, it can not only prevent the window air conditioner 200 from being lifted up and falling to the outdoor side, but also prevent the window air conditioner 200 from being pressed down and dumped indoors. 3) For the scheme that the connector 20 is mounted at the support frame 10 or window frame 301, the upper end of the connector 20 is connected with the side of the window air conditioner 200, and the lower end of the connector 20 abuts against the surface of the windowsill 302, it can not only prevent the window air conditioner 200 from being lifted up and falling to the outdoor side, but also prevent the window air conditioner 200 from being pressed down and falling to the indoor side, and the connector 20 can also assist the support frame 10 to support the window air conditioner 200, so as to improve the mounting stability of the window air conditioner 200.

The following is an example in which the connector 20 is provided at the inner side of the window frame 301. That is, the connector 20 is provided at the inner end of the window frame 301, and the upper end of the connector 20 is used to connect with the window air conditioner 200. The connector 20 is connected with the inner end of the support frame 10, and/or the lower end of the connector 20 is used to abut against the surface of the windowsill 302. In this way, the connector 20 can be mounted indoors and has a large mounting space, so as to be convenient to mount the connector 20.

In this embodiment, the connector 20 is mounted at the transverse extension member 13.

Further, as shown in FIGS. 1, 2 and 12, the upper end of the connector 20 is connected with the side of the window air conditioner 200. In this way, not only the mounting space of the connector 20 can be increased, but also the action arm between the connector 20 and the window air conditioner 200 can be increased, so as to improve the mounting stability of the window air conditioner 200. Of course, in other embodiments, the upper end of the connector can also be connected with the bottom of the window air conditioner, or the upper end of the connector can also be connected with both the bottom and the side of the window air conditioner.

It should be noted that the connector 20 can be either an integral portion or an assembly. In the following embodiments, in order to make the connector 20 have more functions, the connector 20 is designed as an assembly, as shown below.

Further, as shown in FIGS. 1, 2, 12 and 13, the connector 20 includes a first support 21 connected with the inner end of the support frame 10, the lower end of the first support 21 abuts against the surface of the windowsill 302, and the upper end of the first support 21 is connected with the side of the window air conditioner 200. In this way, the indoor part 200*a* of the window air conditioner 200 can be prevented from turning down, so as to prevent the indoor part 200*a* of the window air conditioner 200 from being pressed down and falling to the indoor side.

Further, as shown in FIGS. 1, 2, 12 and 13, the first support 21 has a plurality of support connection positions successively distributed along the up-down direction, and the support connection positions are used for connection with the window air conditioner 200. In this way, each time one of the plurality of support connection positions can be selected to connect with the window air conditioner, so that the first support can adapt to the spacing between the window air conditioner 200 and different types of windowsills 302, so as to improve the applicability of the connector 20.

Further, as shown in FIGS. 1, 2, 12 and 13, the first support 21 is also provided with a third connection through hole, the third connection through hole is a long strip hole extending in the up and down direction, and the third connection through hole defines a plurality of support connection positions. The side of the window air conditioner 200 is provided with a preset connection position 202 cooperated and connected with the third connection through hole. Specifically, the preset connection position 202 may be, but is not limited to, a threaded connection hole, a stud, etc.

In this way, a plurality of the support connection positions are formed through long strip holes, which can facilitate the alignment of the support connection position with the preset connection position 202 for mounting.

Further, as shown in FIGS. 1, 2, 12 and 13, the connector 20 also includes a second support 22, one end of the second support 22 is connected with one end of the support frame 10, and the other end of the second support 22 is connected with the first support 21 to connect the first support 21 to one end of the support frame 10. In this way, it is convenient to install the first support 21 on the support frame 10. At the same time, when the window air conditioner 200 is lifted up, the second support 22 can pull the window air conditioner 200 through the first support 21 to prevent the indoor part 200*a* of the window air conditioner 200 from being lifted up and falling to the outdoor side. Of course, in other embodiments, the other end of the second support 22 can also be directly connected with the window frame 301 to fix the first support 21.

Further, as shown in FIGS. 1, 2, 12 and 13, the first support 21 is movably provided in the up and down direction relative to the second support 22, so that the height of the connection position between the first support 21 and the second support 22 relative to the surface of the windowsill 302 (i.e. the distance between the connection position and the surface of the windowsill 302) can be adjusted, and the height of the connection position between the first support 21 and the window air conditioner 200 relative to the surface of the windowsill 302 can be adjusted, so that the lower end of the first support 21 can abut against the surface of the windowsill 302 to adapt to the spacing between the second support 22 and different windowsills 302, and adapt to the spacing between the window air conditioner 200 and different windowsills 302, so that the connector 20 can be applied to different types of windowsills 302.

Further, as shown in FIGS. 1, 2, 12 and 13, the first support 21 is movably provided in the direction away from or close to the window frame 301 relative to the second support 22, so that the distance between the connection position of the first support 21 and the second support 22 and the window frame 301 can be adjusted to adapt to the distance between the connection position of the first support 21 and different window air conditioners 200 and the window frame 301, so that the connector 20 is adapt to window air conditioners 200 of different lengths.

Further, as shown in FIGS. 1, 2, 12 and 13, the first support 21 is provided with a first connection through hole 211, the first connection through hole 211 is a long strip hole extending in the up-down direction, and the second support 22 is provided at the second connection through hole 221 cooperated and connected with the first connection through hole 211, so that the first support 21 can be movably provided in the up and down direction relative to the second support 22.

Specifically, a fixation member (such as a bolt/screw, or the like) successively pass the first connection through hole 211 and the second connection through hole 221 to connect the first support 21 and the second support 22.

In this way, when the fixation member is in the relaxed/loose state, the first support 21 can move up and down, so that the lower end of the first support 21 abuts against the surface of the windowsill 302. When the first support 21 is moved to the preset assembly position, the fixation member is in a fastened (e.g. locked) state to fixedly connect the first support 21 and the second support 22.

Further, as shown in FIGS. 1, 2, 12 and 13, the first connection through hole 211 and the third connection through hole are the same long strip hole. Thus, since the same long strip hole is used to connect with the window air conditioner 200 and the second support 22 respectively, the structure of the first support 21 can be simplified.

Further, as shown in FIGS. 1, 2, 12 and 13, the second connection through hole 221 is a long strip hole extending in the direction away from/close to the window frame 301, so that the first support 21 can be movably provided in the direction away from or close to the window frame 301 relative to the second support 22. In this way, when the fixation member is in the relaxed/loose state, the first support 21 can move away from or close to the window frame 301, so that the distance between the connection position of the first support 21 and the second support 22 and the support frame 10 can be adjusted.

It should be noted that since a cross structure is formed between the first connection through hole 211 and the second connection through hole 221, so that the first support 21 can move up and down, and can move away from or close to the window frame 301, so as to improve the applicability of the connector 20.

Further, as shown in FIGS. 1, 2, 12 and 13, the first support 21 is a plate-shaped structure, such that the structure of the first support 21 can be simplified.

Further, as shown in FIGS. 1, 2, 12 and 13, the first support 21 includes a vertical support plate 212 and a horizontal abutment plate 213 provided at the lower end of the vertical support plate 212, the first connection through hole 211 is provided at the vertical support plate 212. The horizontal abutment plate 213 is extended close to or far away from the window frame 301, and the lower edge of the horizontal abutment plate 213 is used to abut against the surface of the windowsill 302. In this way, since the horizontal abutment plate 213 is provided, it is convenient to increase the action area when the first support 21 abuts against the surface of the windowsill 302, so that the first support 21 abuts more stably against the surface of the windowsill 302. The side of the vertical support plate 212 attaches with the side of the window air conditioner 200.

In this embodiment, optionally, the horizontal abutment plate 213 is extended in a direction close to the window frame 301 to reduce the mounting space of the connector 20.

Further, as shown in FIGS. 1, 2, 12 and 13, the first support 21 also includes a side abutment plate 214 provided at one end of the horizontal abutment plate 213 away from the vertical support plate 212 and bent and extended to one side. The lower edge of the side abutment plate 214 abuts against the surface of the windowsill 302 to make the first support 21 more stably abut against the surface of the windowsill 302.

In this embodiment, optionally, the horizontal abutment plate 213 is provided perpendicularly to the side abutment plate 214.

Of course, in other embodiments, in order to improve the stability of the first support 21 abutting against the surface of the windowsill 302, a bending abutting portion bent and extended to one side can also be provided at the lower edge of the horizontal abutment plate 213, and the bending abutting portion abuts against the surface of the windowsill 302 to make the first support 21 more stably abut against the surface of the windowsill 302.

Further, as shown in FIGS. 1, 2, 12 and 13, the second support 22 is a plate-shaped structure, such that the structure of the second support 22 can be simplified.

Further, as shown in FIGS. 1, 2, 12 and 13, the second support 22 includes a horizontal support plate 222 extending away from the window frame 301 and a side connection plate 224 extending in the length direction of the windowsill 302. The second connection through hole 221 is provided at the horizontal support plate 222, and the side connection plate 224 is connected to the support frame 10 to mount the second support 22 on the support frame 10. Optionally, the horizontal support plate 222 attaches with the vertical support plate 212, and the side connection plate 224 attaches with the first extension side plate 132. In this way, the second support 22 can be fixedly connected with the support frame 10. Of course, in other embodiments, the side connection plate 224 can also be directly connected with the window frame 301.

Further, as shown in FIGS. 1, 2, 12 and 13, the second support 22 also includes a vertical connection plate 223 provided at one end of the horizontal support plate 222 close to the window frame 301. The vertical connection plate 223 is extended downward, and the side connection plate 224 is provided at the lower end of the vertical connection plate 223 and bent and extended to one side. In this way, the height of the second connection through hole 221 can be increased to increase the distance between the connection position of the first support 21 and the second support 22 and the surface of the windowsill 302, so as to enhance the mounting stability of the first support 21.

Further, as shown in FIGS. 1, 2, 12 and 13, the bending direction of the side abutment plate 214 is opposite to that of the side connection plate 224. In this way, the support effect of the window air conditioner 200 can be improved due to the mounting stability of the connector 20.

In a specific embodiment, the connector 20 (specifically the second support 22) is mounted at the transverse fixation member 1. Optionally, the connector 20 (specifically the second support 22) is mounted at the transverse extension member 13. As shown in FIGS. 1, 2, 12 and 13, the side connection plate 224 is connected with the first extension side plate 132.

Further, as shown in FIGS. 1, 2, 12 and 13, the connector 20 (specifically, the side connection plate 224) is movably provided in the length direction of the transverse extension member 13 relative to the transverse extension member 13, so that the connection position between the connector 20 (specifically, the side connection plate 224) and the transverse extension member 13 (specifically, the first extension side plate 132) can be adjusted in the length direction of the transverse extension member 13 to adapt to different widths of the window air conditioner 200, and combined with the movable characteristics of the transverse extension member 13, it can be applicable to different types of windows to further improve the applicability of the mounting bracket assembly 100.

Further, as shown in FIGS. 1, 2 and 12, 13 and 16, the first extension side plate 132 is provided with a plurality of third connection holes 1322 provided at intervals in the length direction of the transverse extension member 13, and the side connection plate 224 is provided with a fourth connection hole 225 cooperated and connected with the third connection holes 1322. In this way, the fourth connection hole 225 can be connected with one of the third connection holes 1322, so that the connection position between the side connection plate 224 and the first extension side plate 132 can be adjusted in the length direction of the transverse extension member 13. The second connection hole is provided at one side of the plurality of third connection holes 1322.

Specifically, a fixation member (such as a screw, a pin, or the like) successively passes the third connection hole 1322 and the fourth connection hole 225 to connect the side connection plate 224 and the first extension side plate 132 to ensure the reliability of the second support 22.

Further, as shown in FIGS. 1, 2 and 12, 13 and 16, the fourth connection hole 225 is a long strip hole extending in the length direction of the transverse extension member 13. In this way, the range for alignment between the fourth connection hole 225 and the third connection hole 1322 can be improved, so that the second support 22 can be moved for a small distance to make the first support 21 to be better connected with the side of the window air conditioner 200.

Further, as shown in FIGS. 1, 2 and 12, 13 and 16, there are two the connector 20 to be respectively provided at both sides of the window air conditioner 200. In this embodiment, the two connectors 20 are respectively mounted at the two transverse extension members 13.

Further, as shown in FIGS. 1, 2 and 12, 13 and 16, the second extension side plate 133 is provided with a fifth connection hole 1331 and a plurality of sixth connection holes 1332 provided at intervals in the length direction of the transverse extension member 13. The fifth connection hole 1331 can be used for cooperating and connecting with the first connection hole 1221, and the sixth connection hole 1332 can be used for cooperating and connecting with the fourth connection hole 225. In this way, any transverse extension members 13 can be inserted not only at one end of the transverse limit member 12, but also at the other end of the transverse limit member 12, so as to improve the convenience of using transverse extension member 13. In addition, when the connection structure (such as the second connection hole or the third connection hole 1322) on the first extension side plate 132 is damaged, it can also use the second extension side plate 133 to connect the second support 22 and the transverse limit member 12, so as to improve the service life of the transverse extension member 13. Or, the first extension side plate 132 and the second extension side plate 133 may be used alternately to improve the service life of the transverse extension member 13.

Figure 5:
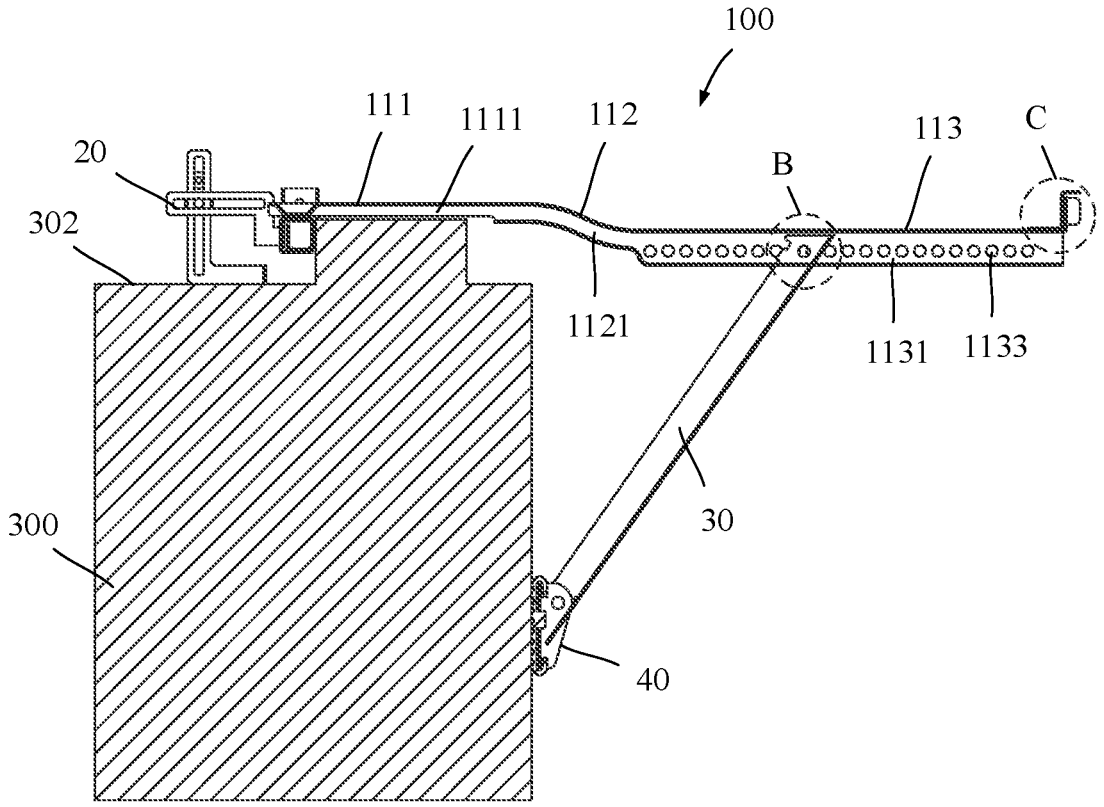
FIG. 5 is a schematic sectional view of the mounting bracket assembly along line I-I in FIG. 3.
Figure 9:
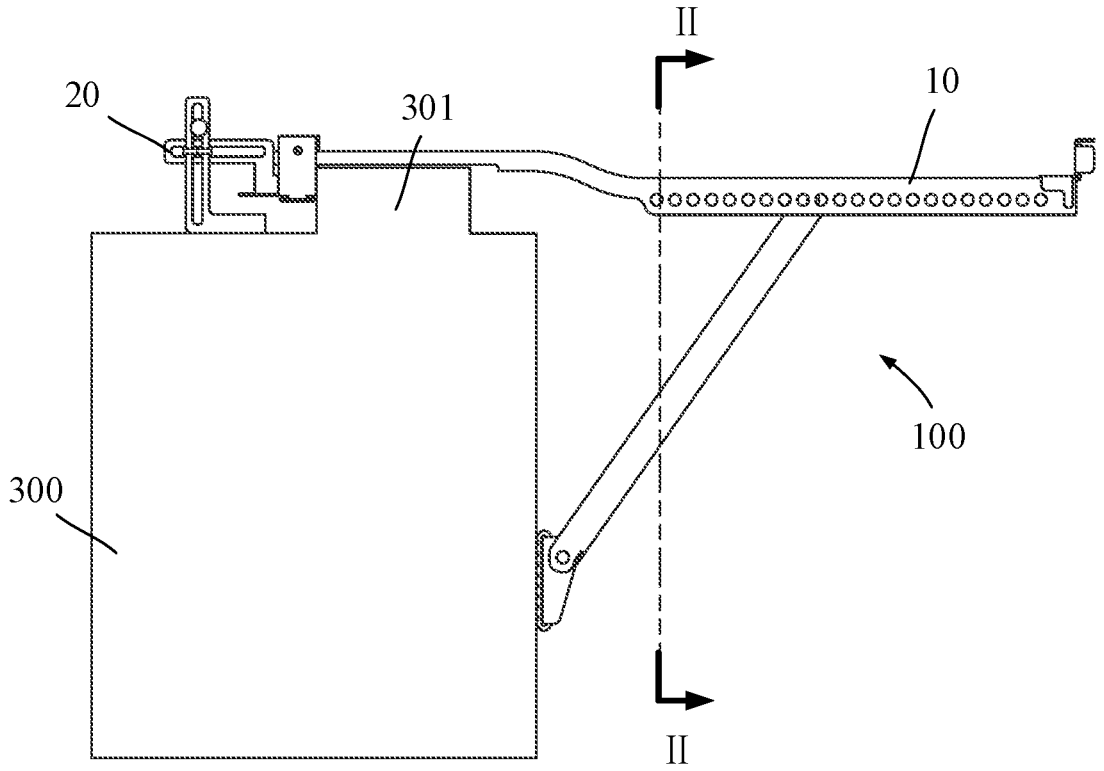
FIG. 9 is a side view of the mounting bracket assembly in FIG. 3.

Further, as shown in FIGS. 5, 9 and 12, the outdoor support is mounted at the support frame 10, and the outdoor support is used to be supported on the wall 300 to improve the mounting reliability of the window air conditioner 200.

Specifically, the outdoor support is an outdoor inclined support 30, and the outdoor inclined support 30 is provided obliquely. As shown in FIGS. 5, 9 and 12, the upper end (i.e., one end, the same below) of the outdoor inclined support 30 is connected with the support frame 10, and the lower end (i.e., the other end, the same below) of the outdoor inclined support 30 abuts against the wall 300. The upper end of the outdoor inclined support 30 is connected with the support plate 11. Of course, in other embodiments, the outdoor support can also be set in other structural forms, such as L-type, which need not be repeated here. It should be noted that this text will take the outdoor support being the outdoor inclined support 30 as an example, but it is not necessary to limit the present application.

In this way, since the outdoor inclined support 30 is set to support the support plate 11 and the support frame 10, the mounting stability of the mounting bracket assembly 100 can be improved, so as to improve the mounting reliability of the window air conditioner 200.

Specifically, as shown in FIGS. 5, 9 and 12, the upper end of the outdoor inclined support 30 is connected with the outer support member 113.

Further, as shown in FIGS. 5, 7, 9 and 12, the upper end of the outdoor inclined support 30 is provided at the support plate 11 in an adjustable position (referring to the connection position) in the length direction of the support plate 11. The upper end of the outdoor inclined support 30 is provided at the outer support member 113 in an adjustable position in the length direction of the support plate 11. Specifically, the outdoor inclined support 30 may be provided below the outer support member 113, and the outdoor inclined support 30 may support the outer support member 113. In the actual mounting process of the mounting bracket assembly 100, due to the thickness difference of the wall 300 and other factors, the length of the outer support member 113 extending out of the window is different. In order to ensure that both ends of the outdoor inclined support 30 are in close contact with the outer support member 113 and the wall 300 respectively, the outdoor inclined support 30 can adjust its cooperating connection position with the outer support member 113, so that the outdoor inclined support 30 can play a good supporting role. Thus, the applicability of the mounting bracket assembly 100 can be improved and convenient for the actual use of the user.

As shown in FIGS. 5, 7, 9 and 12, the lower end of the outdoor inclined support 30 is used to abut against the wall 300.

Further, as shown in FIGS. 5, 7, 9 and 12, the support plate 11 is provided with a plurality of mounting positions provided at intervals in the length direction of the support plate 11, and the upper end of the outdoor inclined support 30 is selectively cooperated and connected with one of the mounting positions. Specifically, a plurality of mounting positions are provided at the outer support member 113. In this way, when being applied to walls 300 with different thicknesses, the upper end of the outdoor inclined support 30 can be cooperated and connected with the mounting positions at different positions.

Further, as shown in FIGS. 5, 7, 9, 10, 12 and 24, a mounting slide groove 1132 extending in the length direction of the support plate 11 is formed below the outer support member 113, and the upper end of the outdoor inclined support 30 is slidably provided in the mounting slide groove 1132. Thus, by making the upper end of the outdoor inclined support 30 slidably provided in the mounting slide groove 1132, it is convenient for the upper end of the outdoor inclined support 30 to select the mounting position connecting different positions.

Further, as shown in FIGS. 5, 7, 9, 10, 12 and 24, each of two opposite sides of the outer support member 113 is provided with a first flange 1131 extending downward, a mounting slide groove 1132 extending in the length direction of the support plate 11 is formed between the two first flanges 1131 and the outer support member 113, and the upper end of the outdoor inclined support 30 is slidably provided in the mounting slide groove 1132 in the length direction of the support plate 11. In this way, the structure of the mounting slide groove 1132 can be simplified. Of course, in other embodiments, the mounting slide groove can also be formed in other ways, which does not need be described in detail here.

Further, as shown in FIGS. 5, 7, 9, 10, 12 and 24, the first flange 1131 is provided with a plurality of first through holes 1133 provided at intervals in the length direction of the support plate 11, and two first through holes 1133 directly provided at the two first flanges 1131 define the mounting position. Therefore, the structure of multiple mounting positions is simple. The upper end of the outdoor inclined support 30 only needs to be cooperated and connected with the corresponding two first through holes 1133 to realize the cooperating connection between the upper end of the outdoor inclined support 30 and one of the mounting positions.

Optionally, as shown in FIGS. 5, 7, 9, 10, 12 and 24, the upper end of the outdoor inclined support 30 is provided with a second through hole cooperated and connected with the first through hole 1133, and the pin passes through the first through hole 1133 and the second through hole respectively, so that the upper end of the outdoor inclined support 30 can be cooperated and connected with the corresponding mounting position, so that the upper end of the outdoor inclined support 30 can be fixed on the outer support member 113.

Figure 7:
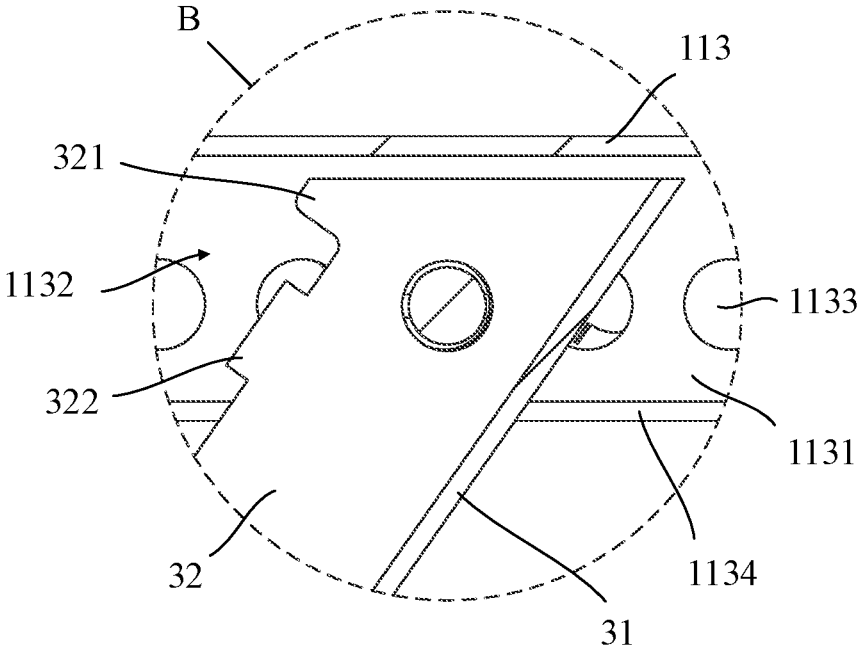
FIG. 7 is a partial enlarged view of portion B in FIG. 5.
Figure 8:
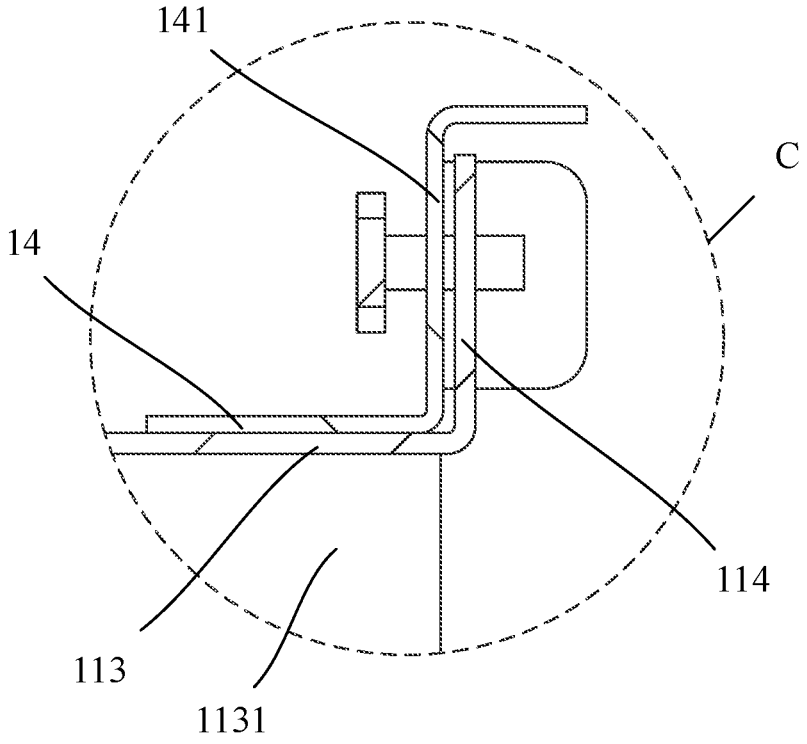
FIG. 8 is a partial enlarged view of portion C in FIG. 5.

Further, as shown in FIGS. 5 and 7, the upper end of the outdoor inclined support 30 abuts against the lower surface of the outer support member 113, which can reduce the stress at the outdoor inclined support 30 and the first flange 1131.

As shown in FIGS. 5 and 7, the upper end of the outdoor inclined support 30 has an upper surface attached with the lower surface of the outer support member 113, so that the upper surface of the outdoor inclined support 30 can abuts against the lower surface of the outer support member 113, so that the upper end of the outdoor inclined support 30 can abut against the lower surface of the outer support member 113. In this way, the contact area between the upper end of the outdoor inclined support 30 and the lower surface of the outer support member 113 can be increased, so as to increase the friction between the upper end of the outdoor inclined support 30 and the lower surface of the outer support member 113, so as to enhance the support effect of the outdoor inclined support 30. At the same time, it can also prevent the outdoor inclined support 30 from rotating upward around the upper end thereof, so as to improve the support effect of the outdoor inclined support 30.

the surface on which the upper surface is located is a plane.

Further, a limit structure is provided between the upper end of the outdoor inclined support 30 and the mounting slide groove 1132. The limit structure limits the upper end of the outdoor inclined support 30 for avoiding separating from the mounting slide groove 1132, that is, the limit structure can prevent the upper end of the outdoor inclined support 30 from separating from the mounting slide groove 1132. In this way, the upper end of the outdoor inclined support 30 can be limited in the mounting slide groove 1132, so that during mounting, the outdoor inclined support 30 can be prevented from separating from the mounting slide groove 1132. On the one hand, the installer can avoid holding the outdoor inclined support 30 all the time, so as to reduce the mounting difficulty of the outdoor inclined support 30. On the other hand, the accidental fall of the outdoor inclined support 30 can be avoided to improve the mounting safety.

Figure 10:
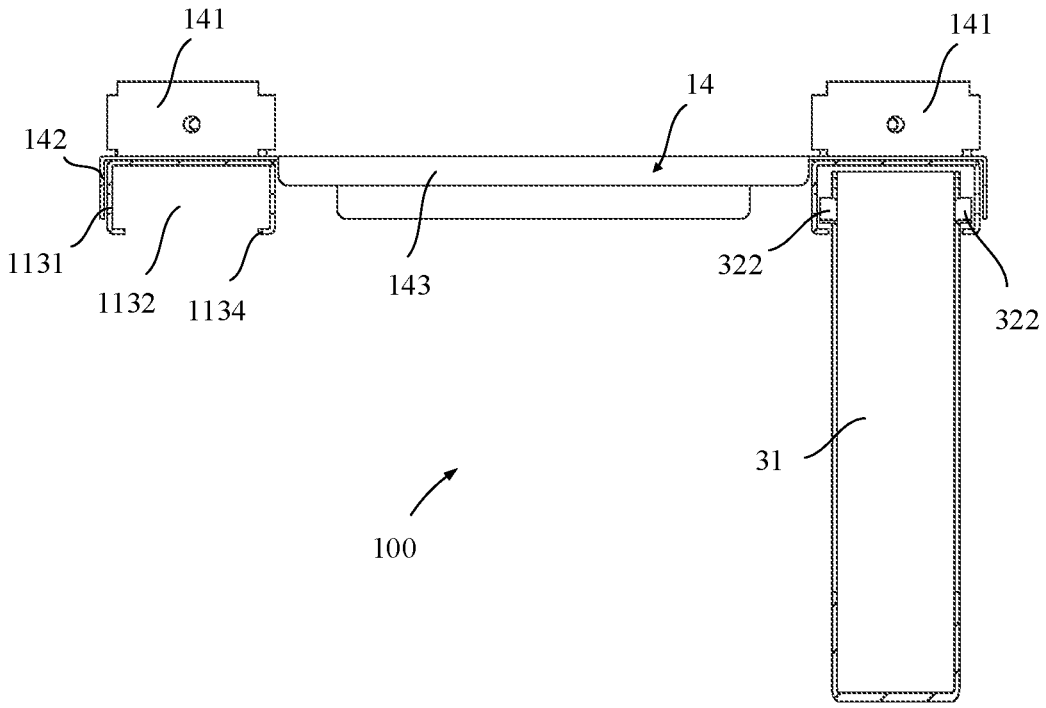
FIG. 10 is a schematic sectional view of the mounting bracket assembly along line II-II in FIG. 9.
Figure 11:
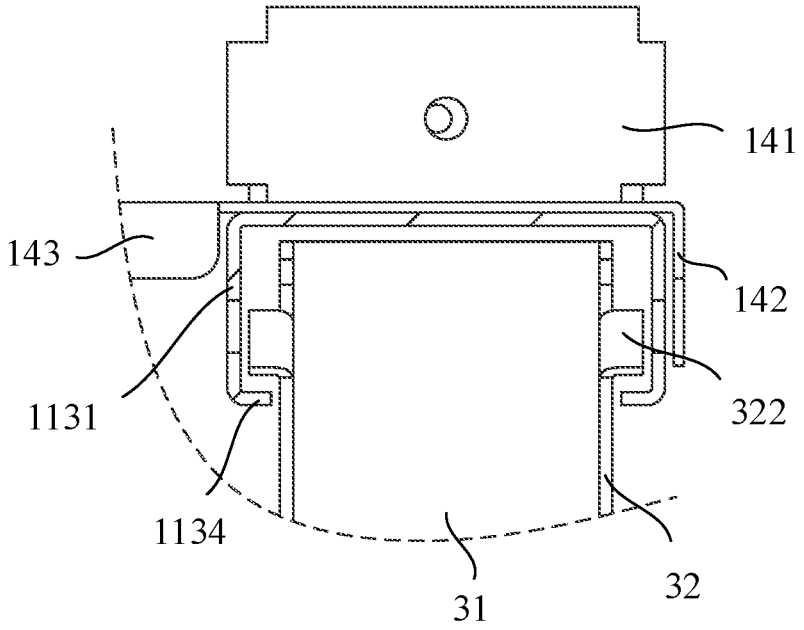
FIG. 11 is a partial enlarged view of an upper end of an outdoor inclined support in FIG. 10.

Further, as shown in FIGS. 10 and 11, the lower edge of at least one of the first flange 1131 is provided with a limit flange 1134 extending in the direction close to the other first flange 1131, the upper end of the outdoor inclined support 30 is provided with a limit lug 322 protruding in the direction close to the first flange 1131, and the limit lug 322 is provided above the limit flange 1134. The limit flange 1134 limits the limit lug 322 for avoiding separating from the mounting slide groove 1132 to limit the upper end of the outdoor inclined support 30 in the mounting slide groove 1132. In this way, the structure of the limit structure can be simplified, and the structural strength of the first flange 1131 can also be improved. Of course, in other embodiments, the limit structure can also be formed in other ways, which need not be described in detail here.

Specifically, when mounting the outdoor inclined support 30, the upper end of the outdoor inclined support 30 can slid into the mounting slide groove 1132 from the outer end of the outer support member 113 (i.e. the end away from the window frame 301). Under the interaction of the limit flange 1134 and the limit lug 322, the upper end of the outdoor inclined support 30 can be limited in the mounting slide groove 1132, so that the installer can loosen the outdoor inclined support 30 and carry out other mounting work. When it is necessary to connect the upper end of the outdoor inclined support 30 with the first flange 1131, the upper end of the outer inclined support can be driven to slide in the mounting slide groove 1132 to make the second through hole opposite to the corresponding first through hole 1133, and then make the pin pass through the first through hole 1133 and the second through hole respectively, so that the upper end of the outdoor inclined support 30 is cooperated and connected with the corresponding mounting position.

In this embodiment, the lower edges of the two first flanges 1131 are provided with limit flanges 1134, and both sides of the outdoor inclined support 30 are provided with limit lugs 322.

Further, as shown in FIGS. 10 and 11, the outdoor inclined support 30 includes an inclined bottom plate 31 and two inclined side plates 32 provided at the two opposite sides of the inclined bottom plate 31, and the second through hole and the limit lug 322 are provided at the inclined side plate 32. In this way, the material and weight of the outdoor inclined support 30 can be reduced, and the structural strength of the outdoor inclined support 30 can be ensured.

As shown in FIG. 9-12, the inclined bottom plate 31 is provided at the side of the inclined side plate 32 away from the wall.

Further, as shown in FIGS. 10 and 11, the limit lug 322 is a folding structure provided at the side edge of the inclined side plate 32. In this way, the difficulty in forming the limit lug 322 can be reduced.

Of course, in other embodiments, the limit lug 322 may also be a limit column, a limit block, or a raised portion protruding on the outside of the inclined side plate 32.

Figure 6:
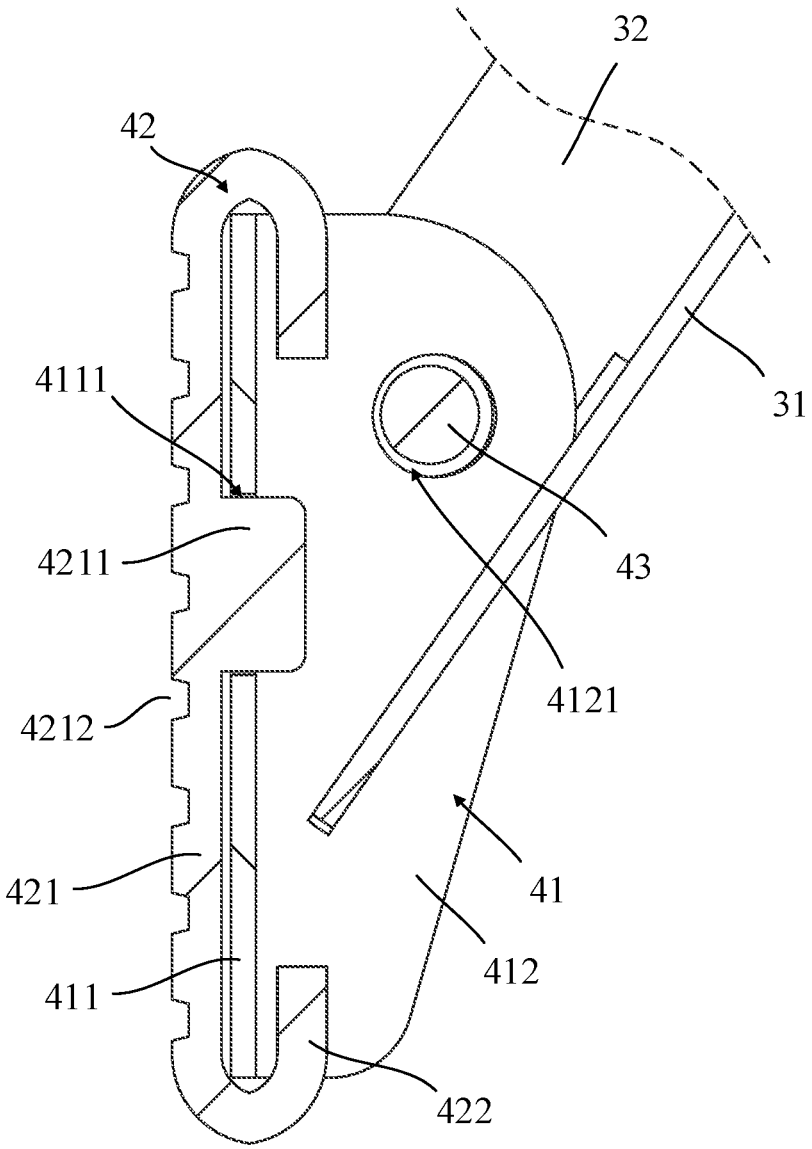
FIG. 6 is a partial enlarged view of a support foot in FIG. 5.

Further, as shown in FIGS. 6 and 7, the upper end of the side edge of the inclined side plate 32 is provided with an anti-rotation convex 321 protruding in the direction close to the wall 300, and the anti-rotation convex 321 abuts against the lower surface of the outer support member 113. In this embodiment, as shown in FIGS. 6 and 7, the anti-rotation convex portion 321 protrudes away from the inclined bottom plate 31. The outdoor inclined support 30 can be prevented from rotating obliquely upward around the upper end thereof, so as to further improve the support effect of the outdoor inclined support 30.

In this embodiment, as shown in FIGS. 6 and 7, the anti-rotation convex 321 is provided above the limit lug 322. It can be understood that through the action of the limit lug 322 and the limit flange 1134, the outdoor inclined support 30 can be prevented from rotating downward around the upper end thereof. At the same time, because the anti-rotation convex 321 can prevent the outdoor inclined support 30 from rotating upward around the upper end thereof, the outdoor inclined support 30 can be prevented from rotating or rotating greatly in the mounting slide groove. In this way, the outdoor inclined support 30 can move/slide in the length direction of the support plate 11 in the mounting slide groove, In addition, the outdoor inclined support 30 can be prevented from rotating or a large extent of rotating in the mounting slide groove.

Further, as shown in FIG. 24, the two opposite sides of the inner support member 111 are provided with a second flange 1111 extending downward to improve the structural strength of the inner support member 111.

Further, as shown in FIG. 24, the two opposite edges of the middle connection member 112 are provided with a third flange 1121 extending downward to improve the structural strength of the middle connection member 112.

Further, as shown in FIGS. 5, 6, 9, 10, 12 and 14, the lower end of the outdoor inclined support 30 is provided with a support foot 40 for abutting against the wall 300. The support foot 40 includes a rotation member 41 and a damping member 42, the rotation member 41 has a rotation connection position to be rotatably connected with the lower end of the outdoor inclined support 30, the rotation member 41 has a resistance action surface for facing the wall 300, the damping member 42 is provided at the resistance action surface, and the damping member 42 is used for abutting against the wall 300.

In this way, the rotation member 41 can connect the outdoor inclined support 30 with the damping member 42, and the rotation member 41 can rotate relative to the wall 300, so that the support foot 40 can be adapted to cooperate with the wall 300 at different inclined angles. When the window air conditioner 200 is placed on the mounting bracket assembly 100, the mounting bracket assembly 100 can transmit pressure to the rotation member 41 and the damping member 42 through the outdoor inclined support 30, and the damping member 42 is closely attached with the wall 300. Since the damping member 42 has a high friction coefficient, there can be a large friction between the support foot 40 and the wall 300, so that the support foot 40 can firmly abut against the wall 300, and the cooperating structure between the outdoor inclined support 30 and the wall 300 can be more firm.

Figure 14:
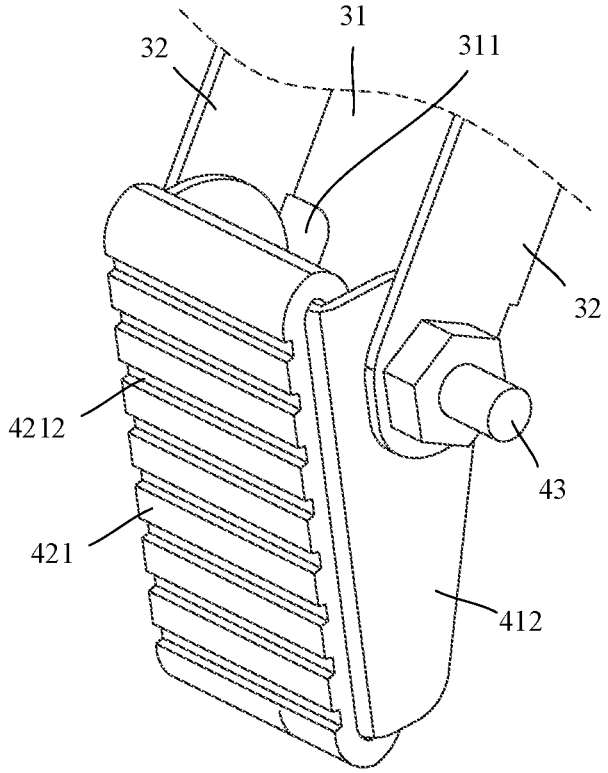
FIG. 14 is a partial enlarged view of one support feet in FIG. 12.
Figure 15:
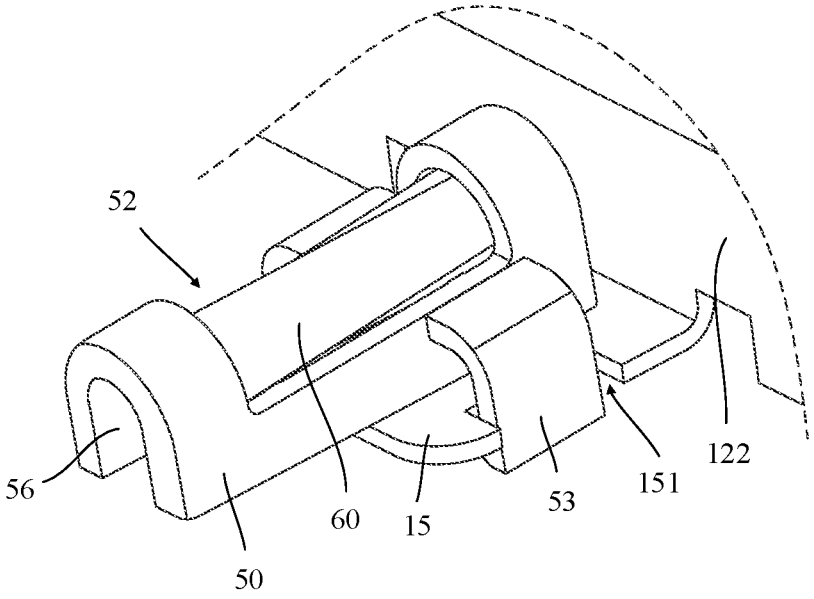
FIG. 15 is a partial enlarged view of a level in FIG. 12.

Optionally, as shown in FIG. 14, the surface of the damping member 42 abutting against the wall 300 is a matt surface, which can increase the friction between the support foot 40 and the wall 300.

As shown in FIG. 14, the surface of the damping member 42 abutting against the surface of the wall 300 is provided with a plurality of non-slip grooves 4212 provided at intervals in the length direction of the damping member 42, and the non-slip grooves 4212 is extended along the width direction of the damping member 42. In this way, the friction between the support foot 40 and the wall 300 can be increased.

Optionally, the non-slip groove 4212 is wavy, which can increase the friction between the support foot 40 and the wall 300.

Optionally, the strength of the rotation member 41 is higher than that of the damping member 42. In this way, the reliability of the support foot 40 can be improved.

Optionally, the damping member 42 is a flexible member, such as a rubber member, etc.

Further, as shown in FIGS. 5, 6, 9, 10, 12 and 14, the rotation connection position is provided close to/biased towards the upper end of the rotation member 41. In this way, on the one hand, the pressure can be better transmitted to the support foot 40, so that the support foot 40 can more firmly abut against the wall, so as to improve the fixation stability of the support foot 40. On the other hand, during mounting, under the action of its own gravity, the resistance action surface of the support foot 40 and the damping member 42 can naturally face the wall 300, so as to reduce the difficulty of mounting.

In this embodiment, the rotation connection position is provided at the upper end of the rotation member 41.

Further, as shown in FIGS. 5, 6, 9, 10, 12 and 14, the rotation member 41 includes a rotation bottom plate 411 and two rotation side plates 412 provided at the two opposite sides of the rotation bottom plate 411. The resistance action surface is the bottom surface of the rotation bottom plate 411, and the rotation connection position is provided at the rotation side plate 412 and close to the upper end of the rotation side plate 412. In this way, the rotation member 41 can have a simple structure, be easy for fabrication and have strong structural strength.

In this embodiment, the rotation connection position is the first rotation hole 4121 passing through the rotation side plate 412. Optionally, the first rotation hole 4121 is provided at the upper end of the rotation side plate 412.

Further, as shown in FIGS. 5, 6, 9, 10, 12 and 14, the lower end of the indoor inclined support is provided with a second rotation hole, and the rotation shaft 43 passes through the first rotation hole 4121 and the second rotation hole respectively, so that the rotation side plate 412 can be rotatably connected with the lower end of the outdoor inclined support 30.

Further, as shown in FIGS. 5, 6, 9, 10, 12 and 14, the two rotation side plates 412 are provided between the two inclined side plates 32. Specifically, the lower end of the inclined bottom plate 31 is provided with two avoidance notches 311, the two rotation side plates 412 are respectively provided in the two avoidance notches 311, and the rotation side plate 412 is rotatably connected with the inclined side plate 32. In this way, the interference of the inclined bottom plate 31 with the rotating of the support foot 40 can be avoided.

As shown in FIGS. 5, 6, 9, 10, 12 and 14, the second rotation hole is provided at the lower end of the inclined side plate 32.

Optionally, the rotation shaft 43 may be a bolt/screw.

Further, as shown in FIGS. 5, 6, 9, 10, 12 and 14, the lower end of the inclined bottom plate 31 protrudes downward from the lower end of the inclined side plate 32. In this way, the lower end of the inclined bottom plate 31 can be used for abutting against the rotation bottom plate 411, so that the rotation bottom plate 411 and the damping pad 421 always face the wall 300, so as to reduce the difficulty in mounting.

Further, as shown in FIGS. 5, 6, 9, 10, 12 and 14, the width of the rotation side plate 412 gradually decreases from top to bottom (i.e., from the upper end of the rotation side plate 412 to the lower end of the rotation side plate 412). In this way, the pressure can be transmitted to the bottom plate 4142 and the damping member 411.

Optionally, the upper corner of the rotation side plate 412 is an arc corner, which can reduce the turning space required for the rotating of the support foot 40.

Optionally, the lower corner of the rotation side plate 412 is an arc corner.

Further, as shown in FIGS. 5, 6, 9, 10, 12 and 14, the damping member 42 includes a damping pad 421 provided at the resistance action surface and two pad connection members 422 respectively provided at both ends of the damping pad 421. The pad connection member 422 is a bended portion, and the two pad connection members 422 respectively wrap two ends of the rotation bottom plate 411 (i.e. the upper end and the lower end). In this way, the damping pad 421 can easily abut against the wall 300, and the damping pad 421 can be easily fixed on the resistance action surface due to the pad connection member 422. In addition, the overall structure of the support foot 40 can be made more concise and convenient for assembly to a certain extent.

Further, as shown in FIGS. 5, 6, 9, 10, 12 and 14, the damping pad 421 is provided with a damping convex 4211, the rotation bottom plate 411 is provided with a damping through hole 4111, and the damping convex 4211 is clamped in the damping through hole 4111. In this way, the connection strength between the damping pad 421 and the rotation member 41 can be enhanced, so as to improve the reliability of the support foot 40.

As shown in FIGS. 5, 6, 9, 10, 12 and 14, the damping convex portion 4211 is extended in the width direction of the damping pad 421.

As shown in FIG. 14, the surface of the damping pad 421 for abutting against the wall 300 is a matt surface. Specifically, the non-slip groove 4212 is provided at the damping pad 421 and is extended in the width direction of the damping pad 421.

Further, as shown in FIGS. 5, 6, 9, 10, 12 and 14, there are provided two support plate 11 in the length direction of the windowsill 302/the width direction of the window air conditioner 200, and there are provided two outdoor inclined supports 30 correspondingly. In this way, the support stability of the window air conditioner 200 can be improved.

Further, as shown in FIGS. 3, 12, 17 and 24, the end of the outer support member 113 away from the window frame 301 is provided with a first folding abutment member 114 extending upward. The first folding abutment member 114 can be used for abutting against the side of the window air conditioner 200 away from the window frame 301, or can be used for preventing the window air conditioner 200 from falling down, such that it can improve the safety and reliability of fixing and supporting the window air conditioner 200 by the mounting bracket assembly 100.

Further, as shown in FIGS. 3, 12, 17 and 24, the support frame 10 also includes a transverse connection plate 14, which connects two support plates 11. In this way, the support capacity of the support frame 10 can be improved.

As shown in FIGS. 3, 12, 17 and 24, the transverse connection plate 14 is provided at one end of the outer support member 113 away from the window frame 301.

As shown in FIGS. 3, 12, 17 and 24, the transverse support plate 11 is provided above the outer support member 113.

Further, as shown in FIGS. 3, 12, 17 and 24, the side edge of the transverse connection plate 14 is provided with two second folding abutment members 141 extending upward, the second folding abutment member 141 is provided corresponding to the first folding abutment member 114, and the second folding abutment member 141 is connected with the first folding abutment member 114. Optionally, the second folding abutment member 141 is connected with the first folding abutment member 114 through a screw locking structure.

Further, as shown in FIGS. 3, 12, 17 and 24, the upper end and left and right edges of the second folding abutment member 141 are provided with flanges extending away from the window frame 301, and the first folding abutment member 114 is provided in the space surrounded by the three flanges.

Further, as shown in FIGS. 3, 12, 17 and 24, the two ends of the transverse connection plate 14 are respectively provided with a first folding plate 142 extending downward, the side edge of the transverse connection plate 14 is provided with a second folding plate 143 extending downward, and the support plate 11 is clamped between the first folding plate 142 and the second folding plate 143. In this way, it is convenient to install the transverse connection plate 14.

It can be understood that when mounting the mounting bracket assembly 100 to the window, it is necessary to install the transverse limit member 12 assembly horizontally at the outlet to ensure that the window air conditioner 200 can be placed horizontally and ensure the operation quality of the window air conditioner 200. Therefore, the mounting bracket assembly 100 is also provided with a level mounting structure. Specifically, the level mounting structure is provided at the inner end of the support frame 10 to facilitate the operator to observe the level 60. Detailed description is as follows.

Further, as shown in FIGS. 4, 15 and 18-24, the mounting bracket assembly 100 is provided with a level mounting member for mounting the level 60. Specifically, the level mounting member is a level mounting plate 15 provided at one end of the support frame 10 and protruding away from the window frame 301, and the level 60 can be mounted at the level mounting plate 15. In this way, the installer can observe the state of the level 60 indoors.

In this embodiment, the level mounting plate 15 is provided at the transverse limit member 12. Optionally, as shown in FIGS. 4, 15 and 18-24, the level mounting plate 15 is provided at the lower edge of the first limit side plate 122.

Further, as shown in FIGS. 4, 15 and 18-24, the mounting bracket assembly 100 also includes a mounting case 50, the mounting case 50 is provided with an accommodation cavity 51 for mounting the level 60, the mounting case 50 is provided with a visible notch 52 communicated with the accommodation cavity 51, and the mounting case 50 is detachably mounted at the level mounting plate 15. Specifically, the mounting case 50 is provided with a detachable connection structure for detachably connecting with the mounting portion of the level.

As shown in FIGS. 4, 15 and 18-24, the level 60 is mounted in the accommodation cavity 51, and the visible notch 52 can expose the level 60 for observing the state of the level 60, so that the horizontal state of the transverse fixation member 1 can be adjusted according to the state of the level 60, so that the transverse fixation member 1 can be mounted horizontally, and then the mounting bracket assembly 100 can be mounted horizontally.

In addition, by detachably mounting the mounting case 50 on the level mounting plate 15, the level 60 can be mounted at the support frame 10 when needed, and the level 60 can be removed when not needed, so as to avoid damaging the level 60 and the mounting case 50.

Thus, when in use, it is only necessary to install the mounting case 50 equipped with the level 60 on the level mounting member of the mounting bracket assembly, so as to reduce the difficulty of mounting the level. Moreover, by mounting the level 60 on the mounting bracket assembly 100 through the mounting case 50, it is easy to ensure/improve the test accuracy of the level 50.

Optionally, the visible notch 52 is provided at the top of the mounting case 50 to facilitate observation of the state of the level 60.

Further, the mounting case 50 is clamped to the level mounting plate 15, that is, the detachable connection structure is a clamp structure for clamping with the level mounting member. In this way, the disassembly and assembly of the mounting case 50 can be made simple and convenient.

Further, as shown in FIGS. 4, 15 and 18-24, the clamp structure includes two elastic clamp arms 53 provided at two opposite sides of the mounting case 50, the lower end of each elastic clamp arm 53 protrudes downward from the bottom of the mounting case 50, the lower end of the elastic clamp arm 53 is provided with a clamp convex 54 protruding in the direction close to the other elastic clamp arm 53, and the bottom of the mounting case 50 is used to abut against the upper surface of the level mounting plate 15. The clamp convex 54 is provided below the level mounting plate 15 and is clamped to/abuts against the lower surface of the level mounting plate 15.

In this way, the clamp convex 54 can be mounted below the level mounting plate 15 through the elasticity of the elastic clamp arm 53. Moreover, because the clamp convex 54 is clamped to/abuts against the lower surface of the level mounting plate 15 and the bottom of the mounting case 50 abuts against the upper surface of the level mounting plate 15, the mounting case 50 can be clamped on the level mounting plate 15.

Optionally, the clamp convex 54 is an inverted buckle to facilitate the mounting of the clamp convex 54 under the level mounting plate 15.

Further, the elastic clamp arm 53 includes a horizontal arm 531 protruding on the side of the mounting case 50 and extending away from the mounting case 50, and a vertical arm 532 provided at one end of the horizontal arm 531 away from the mounting case 50 and bent downward. The clamp convex 54 is provided at the lower end of the vertical arm 532. In this way, an elastic space can be provided for the elastic motion of the elastic clamp arm 53 by setting the horizontal arm 531, and, the clamp convex 54 can be mounted below the mounting plate by setting the vertical arm 532. Moreover, such a setting can also make the elastic clamp arm 53 have sufficient elasticity.

Optionally, the vertical arm 532 is smoothly connected with the horizontal arm 531.

Further, as shown in FIGS. 4, 15 and 18-24, the two opposite side edges of the level mounting plate 15 are respectively provided with a clamp notch 151, and the lower end of the elastic clamp arm 53 is provided in the clamp notch 151. Specifically, the lower end of the vertical arm 532 is provided in the clamp notch 151. In this way, the clamp arm can be limited in the clamp notch 151 to further limit the mounting case 50. Of course, in other embodiments, the clamping through hole can also be directly provided at the level mounting plate 15, and the lower end of the clamp arm can be provided in the clamping through hole.

Further, as shown in FIGS. 4, 15 and 18-24, the bottom of the mounting case 50 is provided with a mounting opening 55 communicated with the accommodation cavity 51, so that the level 60 can be mounted into the accommodation cavity 51 through the mounting opening 55.

Figure 23:
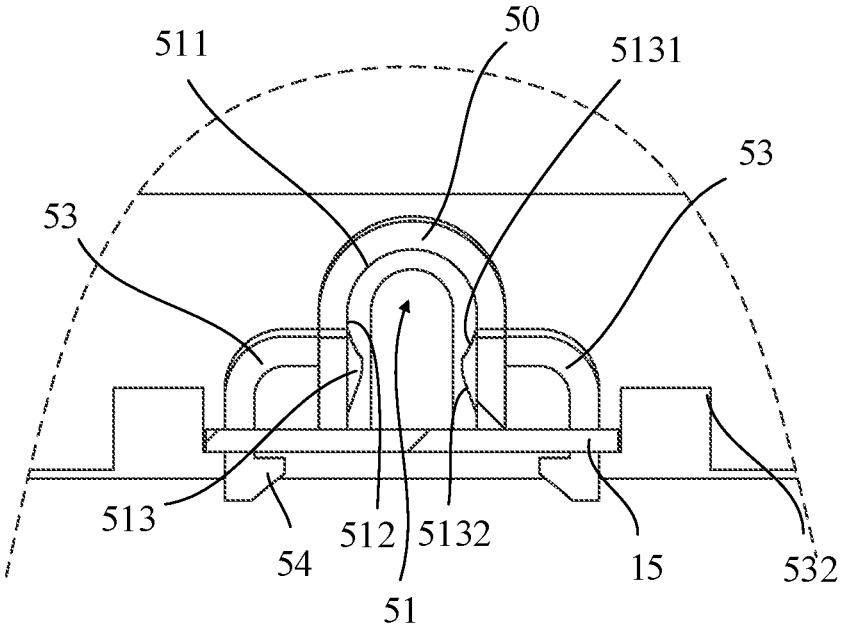
FIG. 23 is a schematic sectional view of the level mounting case along line in FIG. 22.

Further, as shown in FIG. 23, the accommodation cavity 51 includes a top wall surface 511 opposite to the mounting opening 55 and two side wall surfaces 512 connected with the two opposite sides of the top wall surface 511. The side wall surface 512 is convex with a limit convex 513, which is used to limit the level 60 between the limit convex 513 and the top wall surface 511. In this way, the level 60 can be mounted in the accommodation cavity 51.

Further, the shape of the top wall surface 511 fits with the shape of the level 60, and/or the limit convex 513 has a limit surface 5131 facing the level 60 and fitting with the shape of the level 60. In this way, it is convenient to position the level 60. In this embodiment, the level 60 is substantially cylindrical, the top wall surface 511 is a circular arc surface, and the limit surface 5131 is an arc surface.

In this embodiment, the cross-sectional shape of the mounting case 50 is U-shaped.

Further, as shown in FIG. 23, the limit convex 513 also has a guide surface 5132, and the convex height of the guide surface 5132 gradually increases from bottom to top. In this way, when mounting the level 60, it is convenient to guide the level 60 to above the limit convex 513, so as to reduce the difficulty of mounting the level 60.

Further, as shown in FIG. 23, the guide surface 5132 is smoothly connected with the limit surface 5131.

Further, as shown in FIGS. 4, 15 and 18-24, both ends of the mounting case 50 are also respectively provided with end through holes 56 communicated with the accommodation cavity 51. Optionally, the end through hole 56 is also communicated with the mounting opening 55.

Figure 19:
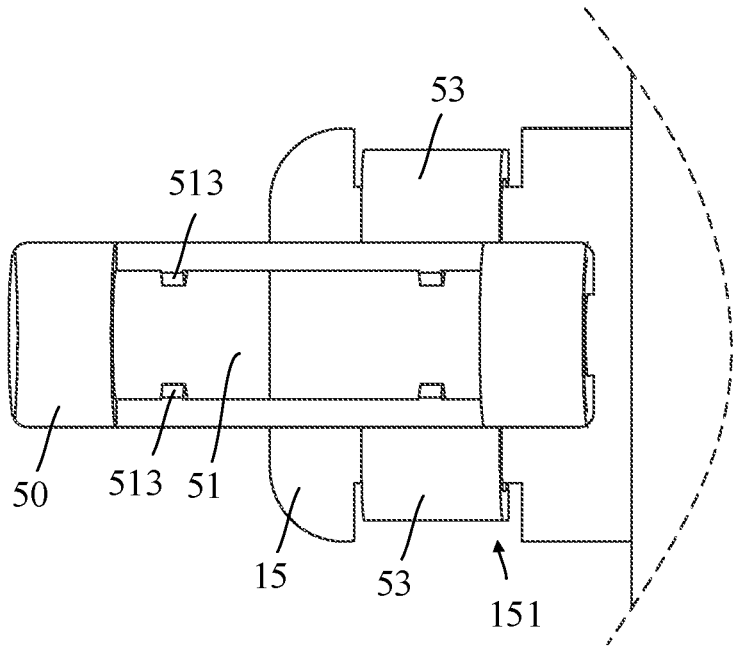
FIG. 19 is a partial enlarged view of a level mounting case in FIG. 18.
Figure 20:
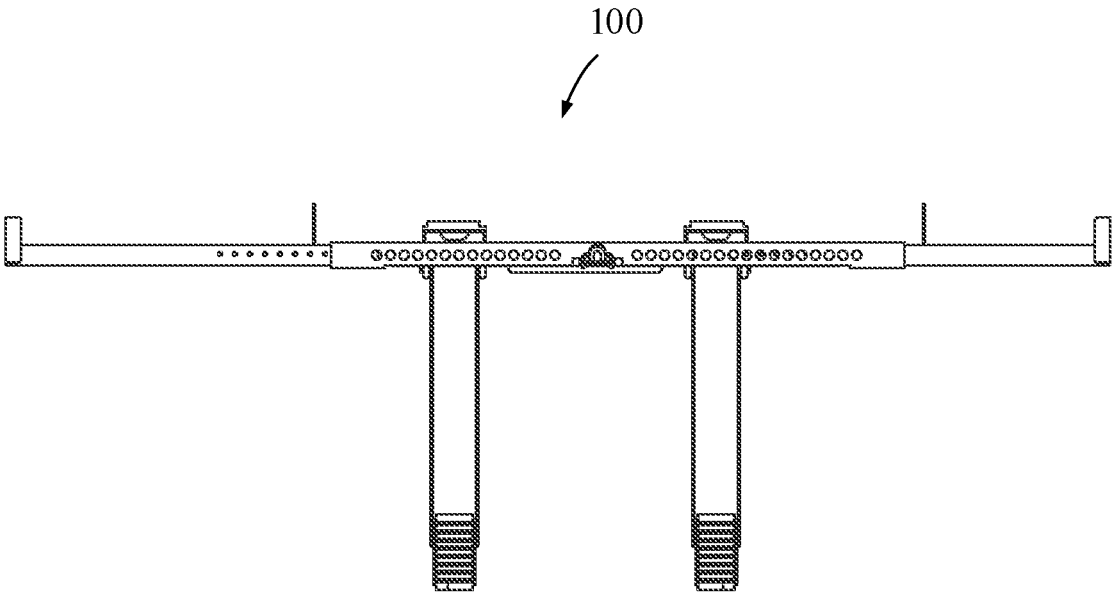
FIG. 20 is a left side view of the mounting bracket assembly in FIG. 18.
Figure 21:
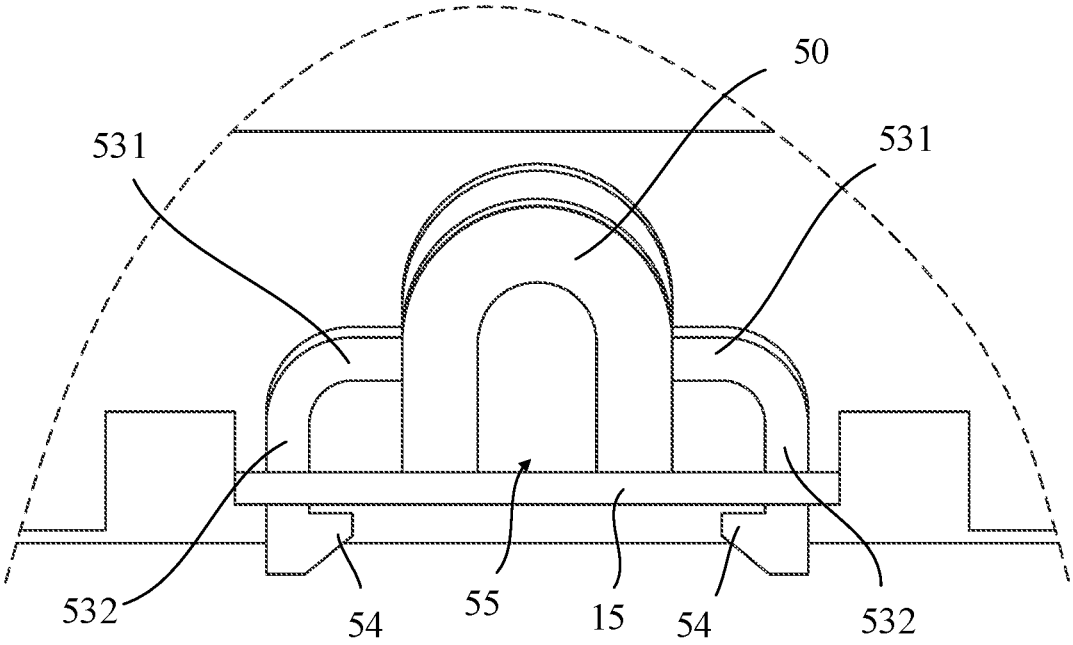
FIG. 21 is a partial enlarged view of the level mounting case in FIG. 20.
Figure 22:
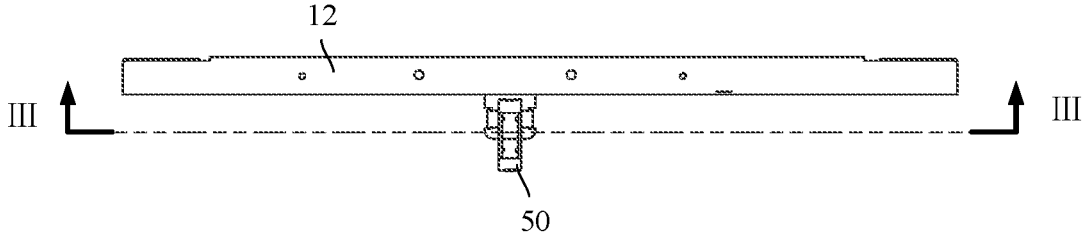
FIG. 22 is a top view of a transverse limit member and the level mounting case in FIG. 20.

Further, as shown in FIG. 19, a plurality of limit convexs 513 are provided at intervals in the direction away from the window frame 301 (i.e. the length direction of the level 60). In this way, the mounting stability of the level 60 can be improved.

In this embodiment, as shown in FIG. 19, two limit convexs 513 are provided at each side wall 512.

The above is only an optional embodiment of the present application and does not limit the scope of the patent of the present application. Any equivalent structural transformation made by using the contents of the description and drawings of the present application under the inventive concept of the present application, or direct/indirect application in other relevant technical fields, is included in the claimed scope of the present application.

The invention claimed is:

1. A mounting bracket assembly comprising:

a support plate including an outer support member, a mounting slide groove being formed at the outer support member and extending in a length direction of the support plate;

an outdoor support, one end of the outdoor support being slidably provided in the mounting slide groove, and a limit structure being provided between the one end of the outdoor support and the mounting slide groove and configured to limit the one end of the outdoor support from separating from the mounting slide groove;

a level mounting member; and a mounting case detachably connected to the level mounting member and configured to mount a level at the level mounting member.

2. The mounting bracket assembly according to claim 1, further comprising:

two flanges each provided at one of two opposite edges of the outer support member and extending in a direction perpendicular to the length direction of the support plate;

wherein the mounting slide groove is formed between the two flanges and the outer support member.

3. The mounting bracket assembly according to claim 2, wherein:

a lower edge of one flange of the two flanges is provided with a limit flange extending towards another one of the two flanges; and the one end of the outdoor support is provided with a limit lug protruding towards the one flange and provided above the limit flange, the limit lug being limited by the limit flange for avoiding separating from the mounting slide groove.

4. The mounting bracket assembly according to claim 3, wherein the one end of the outdoor support is provided at the outer support member and a position of the one end of the outdoor support is adjustable in the length direction of the support plate.

5. The mounting bracket assembly according to claim 4, wherein:

the outer support member is provided with a plurality of mounting positions provided at intervals in the length direction of the support plate; and the one end of the outdoor support is selectively cooperated and connected with one of the plurality of the mounting positions.

6. The mounting bracket assembly according to claim 3, wherein:

the outdoor support includes an outdoor inclined support, the outdoor inclined support including an inclined bottom plate and two inclined side plates provided at two opposite sides of the inclined bottom plate;

the limit lug is provided at one inclined side plate of the two inclined side plates; and an upper end of a side edge of the one inclined side plate is provided with an anti-rotation convex abutting against a lower surface of the outer support member.

7. The mounting bracket assembly according to claim 1, wherein another end of the outdoor support is provided with a support foot including:

a rotation member having a rotation connection position and rotatably connected to the another end of the outdoor support, the rotation connection position being provided close to one end of the rotation member, and the rotation member having a resistance action surface at another end of the rotation member; and a damping member provided at the resistance action surface.

8. The mounting bracket assembly according to claim 7, wherein the rotation member includes a rotation bottom plate and two rotation side plates each provided at one of two opposite sides of the rotation bottom plate, the resistance action surface is a bottom surface of the rotation bottom plate, and the rotation connection position is provided at one rotation side plate of the rotation side plates and close to one end of the one rotation side plate.

9. The mounting bracket assembly according to claim 8, wherein:

the rotation connection position is a rotation hole passing through the one rotation side plate; and/or a width of the one rotation side plate gradually decreases from the one end of the one rotation side plate to another end of the one rotation side plate that is opposite to the one end of the one rotation side plate.

10. The mounting bracket assembly according to claim 1, wherein the mounting case includes:

an accommodation cavity configured to mount the level;

a visible notch provided at a top of the mounting case and communicated with the accommodation cavity; and a detachable connection structure detachably connected to the level mounting member.

11. The mounting bracket assembly according to claim 10, wherein the detachable connection structure includes a clamp structure clamping with the level mounting member.

12. The mounting bracket assembly according to claim 11, wherein:

the clamp structure includes two elastic clamp arms provided at two opposite sides of the mounting case, respectively, a lower end of each of the elastic clamp arms protruding from one side of the mounting case and being provided with a clamp convex protruding towards another one of the elastic clamp arms;

the level mounting member includes a level mounting plate;

the one side of the mounting case abuts against a first surface of the level mounting plate; and the clamp convex is clamped to a second surface of the level mounting plate that is opposite to the first surface of the level mounting plate.

13. The mounting bracket assembly according to claim 12, wherein:

the one side of the mounting case is provided with a mounting opening communicated with the accommodation cavity;

the accommodation cavity includes a top wall surface opposite to the mounting opening and two side wall surfaces connected to two opposite sides of the top wall surface;

a limit convex protrudes from each of the side wall surface, the limit convex being configured to retain the level between the limit convex and the top wall surface.

14. A mounting bracket assembly comprising:

a support plate; and a transverse fixation member connected to one end of the support plate and including:

a transverse limit member including:

a limit top plate;

a first limit side plate and a second limit side plate provided at two opposite side edges of the limit top plate, respectively, a length of the first limit side plate being greater than a length of the second limit side plate; and two limit bottom plates opposite to the limit top plate and provided at two ends of the first limit side plate, respectively;

wherein:

the limit top plate, the first limit side plate, the second limit side plate, and the limit bottom plates enclose to form a mounting space;

a first opening communicated with the mounting space is formed between the two limit bottom plates; and a second opening communicated with the mounting space is formed between the limit bottom plates and the limit top plate where the second limit plate is located.

15. The mounting bracket assembly according to claim 14, wherein the limit bottom plates and the second limit side plate are provided at intervals in a length direction of the transverse limit member to form a third opening communicated with the mounting space and located between the second limit side plate and the second opening.

16. The mounting bracket assembly according to claim 14, wherein the transverse fixation member further includes two transverse extension members slidably mounted in the mounting space in the length direction of the transverse limit member and configured to adjust a length of the transverse fixation member.

17. The mounting bracket assembly according to claim 16, wherein the transverse extension member includes:

an extension bottom plate opposite to the limit top plate; and a first extension side plate and a second extension side plate provided at two opposite side edges of the extension bottom plate, respectively, the first extension side plate being adjacent to the first limit side plate, and the second extension side plate being adjacent to the second limit side plate.

18. The mounting bracket assembly according to claim 17, wherein the transverse limit member is provided with a plurality of first mounting positions provided at intervals in the length direction of the transverse limit member, and the transverse extension member is provided with a second mounting position configured to be connected to and cooperated with one of the first mounting positions.

19. The mounting bracket assembly according to claim 18, wherein:

the first mounting positions are first connection holes provided at the first limit side plate of the transverse limit member and passing through the first limit side plate; and the second mounting position is a second connection hole provided at the first extension side plate of the transverse extension member and passing through the first extension side plate.

20. A window air conditioner assembly comprising:

a window air conditioner; and a mounting bracket assembly including:

a support plate provided at one side of the window air conditioner and including an outer support member supporting an outdoor part of the window air conditioner, a mounting slide groove being formed at the outer support member and extending in a length direction of the support plate;

an outdoor support, one end of the outdoor support being slidably provided in the mounting slide groove, and a limit structure being provided between the one end of the outdoor support and the mounting slide groove and configured to limit the one end of the outdoor support from separating from the mounting slide groove;

a level mounting member; and a mounting case detachably connected to the level mounting member and configured to mount a level at the level mounting member.

* * * * *